US009167641B2

(12) United States Patent
Shackle et al.

(10) Patent No.: US 9,167,641 B2
(45) Date of Patent: Oct. 20, 2015

(54) PHASE CONTROLLED DIMMING LED DRIVER SYSTEM AND METHOD THEREOF

(75) Inventors: Peter W. Shackle, Rolling Hills Estates, CA (US); Zhanqi Du, Baldwin Park, CA (US)

(73) Assignee: LIGHTECH ELECTRONIC INDUSTRIES LTD. (IL)

( * ) Notice: Subject to any disclaimer, the term of this patent is extended or adjusted under 35 U.S.C. 154(b) by 348 days.

(21) Appl. No.: 13/039,842

(22) Filed: Mar. 3, 2011

(65) Prior Publication Data

US 2011/0148318 A1 Jun. 23, 2011

Related U.S. Application Data

(63) Continuation-in-part of application No. 12/324,948, filed on Nov. 28, 2008, now Pat. No. 8,203,276.

(51) Int. Cl.
*H05B 37/02* (2006.01)
*H05B 33/08* (2006.01)

(52) U.S. Cl.
CPC ..... *H05B 33/0815* (2013.01); *H05B 33/0818* (2013.01); *H05B 33/0851* (2013.01)

(58) Field of Classification Search
USPC ..... 315/209 R, 210, 246, 250, 291, 307, 315/308, 312
See application file for complete search history.

(56) References Cited

U.S. PATENT DOCUMENTS 5,272,392 A 12/1993 Wong et al.
5,301,090 A 4/1994 Hed
5,382,881 A 1/1995 Farkas et al.
5,519,313 A 5/1996 Wong et al.
5,559,395 A 9/1996 Venkitasubrahmanian et al.
5,604,411 A 2/1997 Venkitasubrahmanian et al.
5,650,694 A 7/1997 Jayaraman et al.
(Continued)

FOREIGN PATENT DOCUMENTS

WO WO 97/43879 A1 11/1997
WO WO 03/096761 A1 11/2003

OTHER PUBLICATIONS

Rosen, "Dimming Techniques for Switched-mode LED Divers," National Semiconductor, Power-Designer Articles, No. 126, 2009.
(Continued)

*Primary Examiner* — Tung X Le
(74) *Attorney, Agent, or Firm* — GE Global Patent Operation; Peter T. DiMauro

(57) ABSTRACT

The present invention relates to providing an improved dimming driver circuitry, system and a method thereof. The dimming driver circuitry is configured to enable dimming intensity of light generated by one or more light sources, the dimming driver circuitry being connected to a dimmer that provides to it an alternating current (AC) signal. The dimming driver circuitry may in some examples not include a processing unit. Additionally or alternatively, the dimming driver circuitry may in some examples apply amplitude modulation to the output current provided to the one or more light sources. In some of these examples, the dimming driver circuitry may begin to apply at substantially the same time pulse width modulation and amplitude modulation to the output current provided to the one or more light sources. Additionally or alternatively, the dimming driver circuitry may in some examples include at least one linear dimming control pin connected to at least one capacitor and/or resistor configured to fine-tune capacitance and/or resistance.

15 Claims, 11 Drawing Sheets

(56) References Cited

U.S. PATENT DOCUMENTS

| | | | | |
|---|---|---|---|---|
| 5,783,909 | A | 7/1998 | Hochstein | |
| 5,808,422 | A | 9/1998 | Venkitasubrahmanian et al. | |
| 5,850,127 | A | 12/1998 | Zhu et al. | |
| 6,016,038 | A * | 1/2000 | Mueller et al. | 315/291 |
| 6,100,647 | A | 8/2000 | Giannopoulos et al. | |
| 6,356,027 | B1 | 3/2002 | Zhang et al. | |
| 6,586,890 | B2 | 7/2003 | Min et al. | |
| 6,744,223 | B2 | 6/2004 | Laflamme et al. | |
| 6,788,011 | B2 | 9/2004 | Mueller et al. | |
| 7,038,399 | B2 | 5/2006 | Lys et al. | |
| 7,075,251 | B2 | 7/2006 | Chen et al. | |
| 7,221,104 | B2 | 5/2007 | Lys et al. | |
| 7,255,457 | B2 | 8/2007 | Ducharme et al. | |
| 7,256,554 | B2 | 8/2007 | Lys | |
| 7,262,559 | B2 | 8/2007 | Tripathi et al. | |
| 7,309,965 | B2 | 12/2007 | Dowling et al. | |
| 7,352,138 | B2 | 4/2008 | Lys et al. | |
| 7,358,679 | B2 | 4/2008 | Lys et al. | |
| 8,203,276 | B2 | 6/2012 | Shackle et al. | |
| 8,247,992 | B2 * | 8/2012 | Liu et al. | 315/291 |
| 8,339,067 | B2 * | 12/2012 | Lin et al. | 315/291 |
| 2002/0180378 | A1 | 12/2002 | Griffin et al. | |
| 2006/0097666 | A1 | 5/2006 | Venkitasubrahmanian et al. | |
| 2007/0182347 | A1 * | 8/2007 | Shteynberg et al. | 315/312 |
| 2007/0267984 | A1 | 11/2007 | Peng | |
| 2008/0079371 | A1 * | 4/2008 | Kang et al. | 315/309 |
| 2009/0079355 | A1 * | 3/2009 | Zhou et al. | 315/246 |
| 2010/0072903 | A1 * | 3/2010 | Blaut et al. | 315/185 R |
| 2010/0134038 | A1 | 6/2010 | Shackle et al. | |
| 2011/0043134 | A1 * | 2/2011 | Lee | 315/294 |
| 2011/0266967 | A1 * | 11/2011 | Bordin et al. | 315/287 |

OTHER PUBLICATIONS

International Search Report and Written Opinion issued in connection with corresponding PCT Application No. PCT/IL2012/050065 dated Jul. 8, 2012.

* cited by examiner

Phase decode & PWM generation stage

PHASE CONTROLLED DIMMING LED DRIVER SYSTEM AND METHOD THEREOF

CROSS REFERENCE TO RELATED APPLICATIONS

This application is a continuation in part of U.S. application Ser. No. 12/324,948, published on Jun. 3, 2010 as US publication number 2010/0134038, which is hereby incorporated by reference herein.

FIELD OF THE INVENTION

The present invention relates generally to the field of light dimming control.

DEFINITIONS, ACRONYMS AND ABBREVIATIONS

Throughout this specification, the following definitions are employed:

AM: is an acronym for Amplitude Modulation, according to which the strength of the signal is varied in relation to the information being transferred.

TRIAC: is an acronym for TRIode for Alternating Current (AC) that is an electronic component/unit approximately equivalent to two silicon-controlled rectifiers joined in inverse parallel (paralleled but with the polarity reversed) and with their gates connected together.

PWM: is an acronym for Pulse Width Modulation of a signal, which involves the modulation of a signal duty cycle to either control the amount of power transferred to a load or to convey information over a communications channel.

THD: is an acronym for Total Harmonic Distortion. When the current drawn by a power line connected circuit is non-sinusoidal, a Fourier analysis of the resulting current waveform shows the presence of harmonics. The sum of these harmonics, expressed as a percentage of the current, is known as the total harmonic distortion or THD. Zero percent THD means a perfect sine wave. Most lighting prior art electronic equipment has less than 20% THD.

BACKGROUND OF THE INVENTION

In recent years, the usage of LED (Light Emitting Diode) illumination instead of other kinds of illumination (such as the fluorescent illumination, incandescent bulb illumination, and the like), has significantly increased due to the increasing luminosity of LED devices and due to their continuously decreasing costs. Although most people around the world still use fluorescent and incandescent bulb lighting, development of low-cost and efficient LED illuminating devices has recently accelerated rapidly.

Nowadays, various lighting devices include light dimmers, which enable adjusting the power delivered to the light sources, and thereby enable the control of the amount of light generated by these light sources. For this, the user interface of dimmers is usually equipped with an appropriate light adjustment mechanism (e.g., a slider). During such an adjustment, the light outputted from the light sources (e.g., LEDs) is gradually varied, enabling the user to adjust the desired level of illumination, which is the most appropriate for his needs, and to switch said light sources ON and OFF.

Conventional lighting devices are usually powered by an AC source (line voltage power, such as 120V (Volts) RMS (Root Mean Square) at 60 Hz (Hertz) and 230V at 50 Hz); therefore, AC dimmers usually receive the AC line voltage at their input, and then output corresponding AC signals, having one or more variable parameters used to adjust an average voltage of these AC signals in response to a user's operation of the dimmer. Therefore the dimming level desired by the user is encoded (or in other words reflected) in the corresponding AC signals outputted by the dimmer. For example, in response to a user's operation of the dimmer, some models of a typical dimmer powered by a line voltage of 120V RMS may output as low as 35 V RMS whereas some other models of a typical dimmer powered by a line voltage of 120V RMS may output as low as 4 V RMS. In another example, some models of a typical dimmer powered by 240 V RMS may output as low as 70V whereas some other models of a typical dimmer powered by 240 V RMS may output as low as 30 V RMS. Conventional AC dimmers are configured to control the power delivered to light sources in several different ways, such as increasing/decreasing voltage amplitude of the AC output signal and adjusting the duty cycle of the AC output signal (for example, by chopping-out portions of the AC voltage cycle). This technique is sometimes called phase/angle modulation, since it is based on the adjustable phase angle of the AC output signal. Usually, dimmers that implement such angle modulation use a TRIAC component/unit that is selectively operated to adjust the duty cycle of the AC signal outputted from the dimmer, and thereby to modulate the phase angle. Such dimmers are therefore called "TRIAC dimmers".

The early technology in the field of LED illumination was based on providing a DC (Direct Current) power supply and then using a microprocessor to operate a PWM (Pulse Width Modulation) switch to control the brightness of the perceived light. On the other hand, in the fields of fluorescent and incandescent bulb lighting, the control of light has long been available by using phase control dimmers, such as the TRIAC dimmers. However, the use of TRIAC dimmers for other than incandescent lighting requires the overcoming of several problems, such as TRIAC instability.

The problems related to providing LED illumination have been recognized in the Prior Art, and various systems and methods have been developed to provide a solution.

U.S. Pat. No. 6,586,890 discloses a driver circuit that provides power to LEDs by using pulse width modulation (PWM). The driver circuit uses current feedback to adjust power to LED arrays and provides a full light and a dim mode.

U.S. Pat. No. 5,783,909 describes a method of controlling the light output from a LED by using PWM control of the LED current in response to signals provided from a light sensor, in order that the generated light will remain constant.

U.S. Pat. No. 6,788,011 presents systems and methods related to LED systems capable of generating light, such as for illumination or display purposes. The light-emitting LEDs may be controlled by a processor to alter the brightness and/or color of the generated light, e.g., by using pulse-width modulated signals. Thus, according to U.S. Pat. No. 6,788,011, the resulting illumination may be controlled by a computer program to provide complex, pre-designed patterns of light.

U.S. Pat. No. 7,038,399 relates to methods and apparatus for providing power to devices via an AC (Alternating Current) power source, and for facilitating the use of LED-based light sources on AC power circuits that provide signals other than standard line voltages. In one example, LED-based light sources may be coupled to AC power circuits that are controlled by conventional dimmers.

U.S. Pat. No. 6,744,223 discloses a multicolor lamp system that includes a dimming circuit and an illumination module electrically connected to the dimming circuit. The illumination module has a detection circuit for detecting the output of the dimming circuit. The detection circuit generates a detection signal corresponding to the output of the dimming circuit. A microcontroller is programmed to receive the detection signal and to supply a corresponding electrical signal to a plurality of LEDs.

U.S. Pat. No. 5,604,411 presents a dimming ballast for use with a phase control dimmer, including an EMI filter to avoid excessive voltage and peak currents in the filter due to resonance with the phase controlled AC waveform at low conduction angles, when the load presented by the lamp is low. The ballast includes circuitry to sense the rectified DC voltage and to discharge the filter capacitor when the rectified voltage is at or near zero, to thereby keep the EMI filter loaded and prevent misfiring of the phase control dimmer.

SUMMARY OF THE INVENTION

According to some embodiments of the invention, there is provided a dimming driver circuitry configured to enable dimming the intensity of light generated by at least one light source, the dimming driver circuitry being connected to a dimmer that outputs to it an alternating current (AC) signal, wherein the dimming driver circuitry after receiving the AC signal begins substantially at the same time to apply amplitude modulation (AM) and pulse width modulation (PWM) to an output current provided to the at least one light source.

According to some of these embodiments, the dimming driver circuitry includes at least one linear dimming control pin connected to at least one capacitor and/or resistor which is configured to fine-tune capacitance and/or resistance in order to adjust the outputted current with respect to a predetermined dimming level reflected in the AC signal.

According to some of these embodiments, the circuitry does not include a processing unit.

According to some of these embodiments, the at least one light source includes at least one light emitting diode (LED).

According to some embodiments of the invention, there is provided a dimming driver circuitry configured to enable dimming the intensity of light generated by at least one light source that is connected to the dimming driver circuitry, the dimming driver circuitry being connected to a dimmer that outputs to it an alternating current (AC) signal, wherein the dimming driver circuitry includes at least one linear dimming control pin connected to at least one capacitor and/or resistor configured to fine-tune capacitance and/or resistance in order to adjust onset point of dimming of the at least one light source with respect to dimmer adjusting means position.

According to some of these embodiments, the at least one linear dimming control pin is used in a factory to fine-tune the capacitance and/or resistance.

According to some of these embodiments, the circuitry does not include a processing unit.

According to some of these embodiments, the at least one light source includes at least one light emitting diode (LED).

According to some embodiments of the invention, there is provided a dimming driver circuitry configured to output a current which enables dimming the intensity of light generated by at least one light source, the dimming driver circuitry being connected to a dimmer that outputs to it an alternating current (AC) signal, wherein the dimming driver circuitry includes at least one linear dimming control pin connected to at least one capacitor and/or resistor configured to fine-tune capacitance and/or resistance in order to adjust the outputted current with respect to a predetermined dimming level reflected in the AC signal, so that the light intensity is within 10% of average light intensity provided by a plurality of dimming driver circuitries when a plurality of dimmer adjusting means relating to the plurality of circuitries are positioned to correspond to a predetermined low light intensity.

According to some of these embodiments, the circuitry does not include a processing unit.

According to some of these embodiments, the at least one light source includes at least one light emitting diode (LED).

According to some embodiments of the invention, there is provided a dimming driver circuitry configured to receive an alternating current (AC) signal from a dimmer and to enable dimming the intensity of light generated by at least one light source that is connected to the dimming driver circuitry, comprising: (a) an input stage configured to receive the AC signal and output a rectified direct current (DC) signal; (b) a decode stage configured to decode a dimming level encoded in the rectified DC signal, which is desired for the at least one light source; and (c) an output stage configured to amplitude modulate a signal based on the decoded dimming level, and configured to output the signal to the at least one light source.

According to some of these embodiments, the circuitry further comprises: (d) a pulse width modulation (PWM) generation stage configured to generate a PWM signal to be provided to the output stage, the PWM signal having duty cycle set according to the decoded dimming level; wherein the output stage is further configured to receive the PWM signal, and wherein the outputted signal to the light source is both pulse width modulated and amplitude modulated for enabling dimming the light intensity of the at least one light source, the pulse width modulation applied to the at least one light source at a frequency substantially unrelated to the frequency of the AC signal provided from the dimmer.

In some cases with pulse width modulation, the amplitude modulation and the pulse width modulation both begin substantially at the same time.

In some cases with pulse width modulation, the signal outputted from the output stage is chopped, according to the PWM According to some of these embodiments, the at least one light source includes at least one light emitting diode (LED).

According to some of these embodiments, the dimmer is a phase control dimmer. In some cases of these embodiments, the dimmer is a forward phase control dimmer.

According to some of these embodiments, the dimmer includes an adjusting means for controlling dimming level of the at least one light source.

According to some of these embodiments, the decode stage includes at least one linear dimming control pin connected to at least one capacitor and/or resistor which is configured to fine-tune capacitance and/or resistance in order to adjust the outputted signal with respect to the decoded dimming level.

According to some of these embodiments, the output stage includes a controller or microcontroller configured to control the amplitude modulation of the outputted signal.

According to some embodiments of the invention, there is provided a method of enabling dimming the intensity of light generated by at least one light source, comprising: receiving an alternating current (AC) signal from a dimmer; and after receiving the AC signal beginning at substantially the same time to apply amplitude modulation (AM) and pulse width modulation (PWM) to an output current provided to the at least one light source.

According to some embodiments of the invention, there is provided a method of enabling dimming the intensity of light generated by at least one light source, comprising: receiving an alternating current AC signal from a dimmer; and fine-tuning capacitance and/or resistance using a linear dimming control pin, in order to adjust onset point of dimming of the at least one light source with respect to position of adjusting means of the dimmer.

According to some embodiments of the invention, there is provided a method of outputting a current which enables dimming the intensity of light generated by at least one light source, comprising: receiving an alternating current AC signal from a dimmer, reflecting a predetermined dimming level; and fine-tuning capacitance and/or resistance using a linear dimming control pin, in order to adjust the outputted current with respect to the predetermined dimming level, so that the light intensity is within 10% of average light intensity provided by a plurality of dimming driver circuitries when a plurality of dimmer adjusting means relating to the plurality of circuitries are positioned to correspond to a predetermined low light intensity.

According to some embodiments of the invention, there is provided a method of receiving an alternating current (AC) signal from a dimmer and enabling dimming the intensity of light generated by at least one light source that is connected to the dimming driver circuitry, comprising: (a) receiving the AC signal and outputting a rectified direct current (DC) signal; (b) decoding a dimming level encoded in the rectified DC signal which is desired for the at least one light source; (c) amplitude modulating a signal based on the decoded dimming level; and (d) outputting the amplitude modulated signal to the at least one light source.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

Figure 1A:
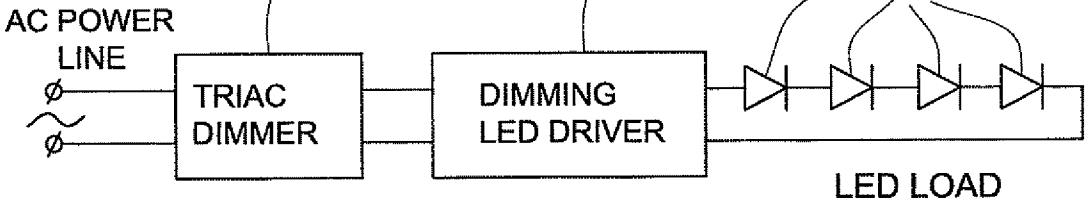
FIG. 1A is a schematic block diagram of a system that comprises an improved phase controlled dimming LED driver, according to an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PREFERRED EMBODIMENTS

In the following detailed description, numerous specific details are set forth in order to provide a thorough understanding of the invention. However, it will be understood by those skilled in the art that the present invention may be practiced without these specific details. In other instances, well-known methods, systems, procedures, components, units, circuits and the like have not been described in detail so as not to obscure the present invention.

Reference in the description to "an embodiment", "another embodiment", "a further embodiment", "this embodiment", "these embodiments", "some cases", "other cases", "an instance", "some instances", "an example", "some examples" or variants thereof means that a particular feature, structure or characteristic described in connection with the embodiment(s) is included in at least one embodiment of the invention. Thus the appearance of the phrase "an embodiment", "another embodiment", "a further embodiment", "this embodiment", "these embodiments", "some cases", "other cases" "an instance", "some instances", "an example", "some examples" or variants thereof does not necessarily refer to the same embodiment(s).

It should be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

As used herein, the phrase "for example," "such as", "for instance" and variants thereof describe non-limiting embodiments of the present invention.

For simplicity of description, the embodiments described below assume usage of LED based source(s). However other embodiments which include other types of light illumination sources may use similar systems and methods to those described below, mutatis mutandis. Therefore, hereinafter, whenever the term "light source" is mentioned, it should be understood that it refers to any type of light illumination source, such as an LED-based source, an incandescent source (a filament lamp, a halogen lamp, etc.), a high-intensity discharge source (sodium vapor, mercury vapor, a metal halide lamp and the like), a fluorescent source, a plasma lamp, a phosphorescent source, laser, an electroluminescent source, a pyro-luminescent source, a cathode-luminescent source using electronic satiation, a galvano-luminescent source, a crystallo-luminescent source, a kine-luminescent source, a candle-luminescent source (a gas mantle, a carbon arc radiation source, and the like), a radio-luminescent source, a luminescent polymer, a thermo-luminescent source, a tribo-luminescent source, a sono-luminescent source, an organic LED-based source and/or any other type of a light illumination source.

For simplicity of description, the embodiments described below assume usage of a dimmer which implements angle modulation, for example a TRIAC dimmer. However in other embodiments, a dimmer may output power line control signals instead of or in addition to phase control signals, and similar systems and methods to those described below may be used, mutatis mutandis. For simplicity of description, the embodiments described below assume usage of a dimmer which is a TRIAC forward phase control dimmer. However in other embodiments, the dimmer may be a reverse phase control (or trailing edge) dimmer (e.g. based on Silicon Control Rectifiers—SCRs), and similar systems and methods to those described below may be used, mutatis mutandis.

FIG. 1A is a schematic block diagram of system 100 that comprises an improved phase controlled dimming LED (Light Emitting Diode) driver circuit 110, according to an embodiment of the present invention. System 100 comprises a TRIAC dimmer 105 for enabling regulating brightness of light generated by LED load 115 that contains one or more LEDs, said TRIAC dimmer 105 connected to an AC power line; and phase controlled dimming LED driver circuit 110 for receiving controlled AC line voltage from said TRIAC dimmer 105 and providing regulated voltage to said LED load 115.

According to an embodiment of the present invention, TRIAC dimmer 105 enables a user of system 100 to regulate the light illumination. When the TRIAC dimmer is controlled up and down by a user (e.g., by using a conventional adjusting means, such as a slider provided on said TRIAC dimmer 105), then illumination of LEDs provided within LED load 115 becomes brighter and dimmer, respectively. Phase controlled dimming LED driver 110 receives a power input from TRIAC dimmer 105, which in turn is fed by an AC power line. LED driver 110, for example, can receive voltages from 115 to 4V [Volts] RMS [Root Mean Square], in the example of a 120V system 100, or for example can receive voltages from 230 to 30V RMS, in the example of a 240V system 100.

According to an embodiment of the present invention, TRIAC dimmer 105 comprises a TRIAC component (unit) that operates in a substantially stable manner. The TRIAC unit is a latching unit, which is either ON or OFF. It is triggered ON at a point in time, which is an adjustable interval after the AC power line voltage zero crossing. When it turns ON, the voltage which is applied to dimming LED driver 110 can vary, for example, from a zero value to 108V (in a 120V system 100), or for example, from a zero value to 198V (in a 240V system 100), in a microsecond. Inside the TRIAC dimmer 105 can be provided a relatively small inductor (not shown) that is intended to prevent the current from rising unduly fast. This may be required because an input stage 120 (FIG. 1B) of dimming LED driver 110 can have capacitors for providing the EMI (Electromagnetic Interference) protection. Without providing said inductor, the current through said capacitors may become relatively high for a brief period of time, which in turn can be disruptive to system 100. Once the TRIAC component is turned ON, it remains conducting until the current through it goes to zero, upon which it turns OFF again.

According to an embodiment of the present invention, phase controlled LED driver 110 does not contain a processing unit (e.g. microprocessor, controller, microcontroller, etc.). Additionally or alternatively, according to another embodiment, phase controlled LED driver 110 pulse width modulates the current outputted to LED load 115 at a frequency unrelated to the AC power line frequency.

Additionally or alternatively, according to another embodiment of the present invention, phase controlled LED driver 110 applies both amplitude modulation and pulse width modulation substantially simultaneously to the current outputted to LED load 115, enabling "deep" light dimming, where the light generated by means of LED load 115 can be dimmed, for example, down to 0.1% of the full light brightness. In some cases of this embodiment there is a difference in the position of the dimmer adjusting means (e.g. slider) between the start of the pulse width modulation and the start of the amplitude modulation, In other cases of this embodiment, pulse width modulation and amplitude modulation begin substantially at the same position of the dimmer adjusting means and therefore at substantially the same time.

Additionally or alternatively, according to a further embodiment of the present invention, the "deep" dimming is enabled by gradually phasing in a power dissipating load (resistor R53 (FIG. 2D, FIG. 4D)), as the LED load 115 output current is being reduced and phased back by means of a PWM signal, for the purpose of providing a sufficient load to the TRIAC component located within TRIAC dimmer 105 to keep said TRIAC component operating in a substantially stable manner and enabling continuous "deep" dimming.

Additionally or alternatively, according to another embodiment, phase controlled LED driver 110 may include at least one linear dimming control pin connected to at least one capacitor and/or resistor for fine-tuning capacitance and/or resistance.

Additionally or alternatively, according to still a further embodiment of the present invention, an assemblage of two or more dimming LED drivers 110 can be constructed for enabling color light mixing, wherein said dimming LED drivers 110 are being independently controlled by means of one or more phase control dimmers (such as TRIAC dimmer 105), so that any desired color (multicolor) light can be generated. For this, LED load 115 can be provided in groups of red LEDs, blue LEDs and green LEDs. If all groups of LEDs are switched ON to a suitable degree (all twelve LEDs are ON), then the produced light color is white. Thus, the light color can be adjusted by modulating the light output of the different groups of LEDs: for example, by partially turning OFF a blue group of LEDs. When said blue group of LEDs is turned OFF, then the intensity of the blue light is reduced, resulting in producing a different light color.

Figure 1B:
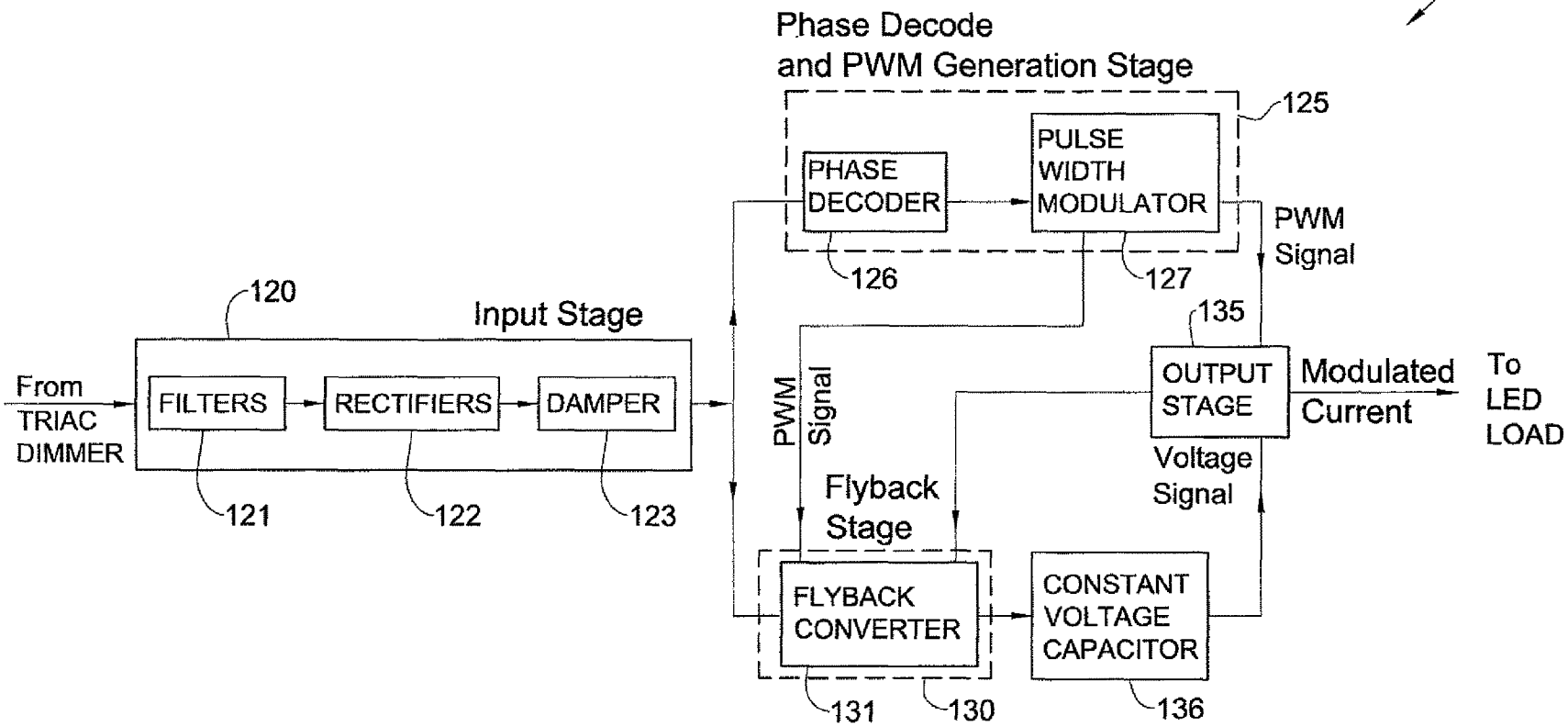
FIG. 1B is a schematic block diagram of the phase controlled dimming LED driver, according to an embodiment of the present invention.

FIG. 1B is a schematic block diagram of the phase controlled dimming LED driver circuit 110, according to an embodiment of the present invention. Phase controlled dimming LED driver 110 comprises four stages: a) an Input Stage 120; b) a Flyback converter stage 130; c) a Phase Decoder and PWM Generation stage 125; and d) an Output Stage 135.

Figure 2A:
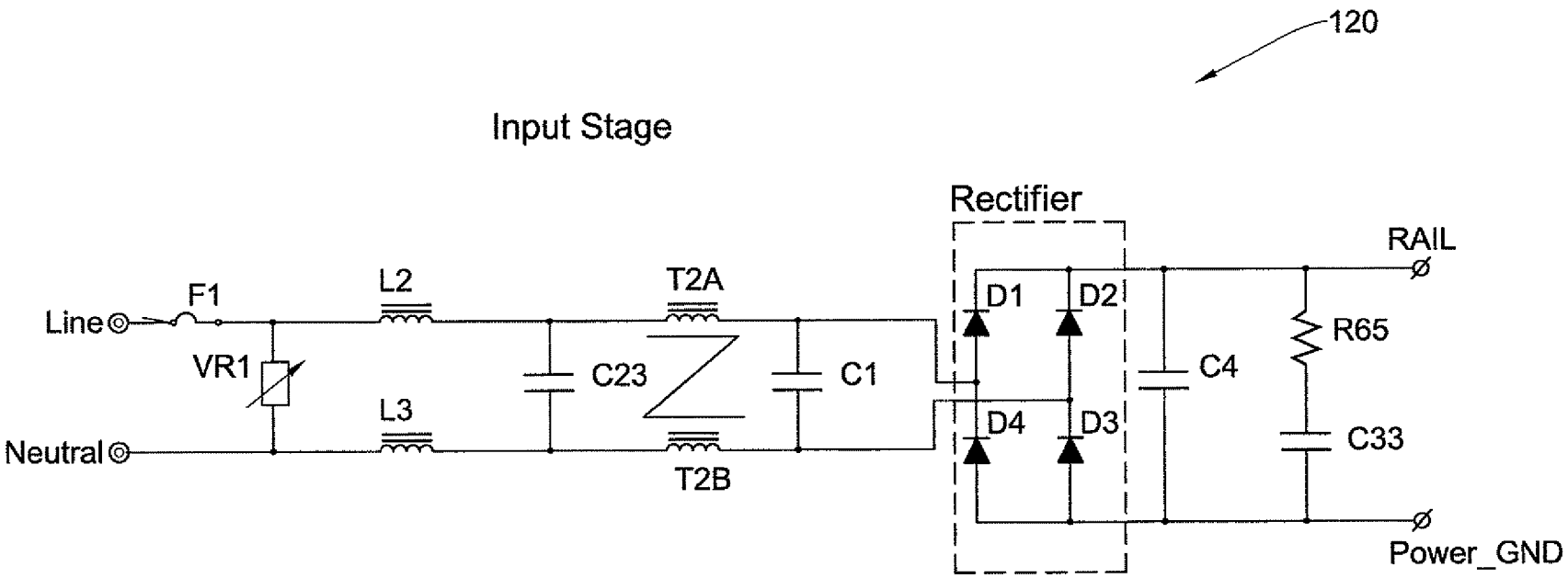
FIG. 2A is a schematic drawing of an Input stage of the phase controlled dimming LED driver, according to an embodiment of the present invention.

According to an embodiment of the present invention, Input Stage 120 comprises Filters 121 for receiving an AC input signal and preventing noise generated in the driver module from escaping onto the AC power line; Rectifiers 122 for converting (rectifying) the received AC signal into a DC (Direct Current) signal; and Damper 123 for damping down the ringing current, which flows between inductors L2 and L3 and capacitors C23, C1 and C4 (FIG. 2A). Input Stage 120 receives AC power input from TRIAC Dimmer 105 (FIG. 1A), which in turn is fed from a conventional AC power line (e.g., 120 or 240 Volts). The output of Input Stage 120 is a rectified DC signal provided into both Flyback stage 130 and Phase Decoder and PWM Generation stage 125.

According to an embodiment of the present invention, Phase Decode and PWM Generation Stage 125 comprises Phase Decoder 126 and Pulse Width Modulator 127 for generating a PWM signal and providing it into Output stage 135 for regulating brightness dimming of LEDs within LED load 115. The input into Phase Decode and PWM Generation Stage 125 is a rectified DC voltage signal outputted from Input stage 120. In addition, Phase Decode and PWM Generation Stage 125 receives auxiliary 15V power voltage from Flyback converter stage 130. The output of Phase Decode and PWM Generation Stage 125 goes through optocoupler U2 (FIG. 2B, 4B), and consists of a signal, which is pulse width modulated at approximately 600 Hz. The information in this signal is only time information, and there is substantially no amplitude information. Phase Decode and PWM Generation Stage 125 switches the output voltage ON and OFF in a predetermined manner. At the full intensity of the light source (LED load 115), the output voltage is continuously switched ON; on the other hand, as the light is dimmed, a gap opens up in each PWM cycle and widens until it becomes, for example, a 92% gap. The output current goes down to only 8%, when the input voltage is only half dimmed; in other words, the lower part of the TRIAC component range is not used, and LED load 115 is fully dimmed when still a relatively high level of voltage is applied to Input stage 120.

Flyback converter stage 130 comprises Flyback converter 131 that receives a rectified DC voltage signal from Input stage 120. It should be noted that Flyback converter 131 can draw power from the AC power line with better than 20% THD (Total Harmonic Distortion), when substantially no phase control is applied to LED driver 110. It should be noted that when TRIAC phase control is applied, then the THD of the AC line current can be, for example, 60% or more. Further, it should be noted that regardless of the level of the phase control, according to which the TRIAC component (provided within TRIAC dimmer 105 (FIG. 1A)) chops up the waveform inputted into Input stage 120, Flyback converter 131 produces a substantially smooth and relatively highly regulated DC voltage on constant voltage capacitor C12 (FIG. 2D, 4D), which is provided at the output of said Flyback converter stage 130 (it is supposed, for example, that said regulated DC voltage is substantially 60V). An information input to Flyback converter 131 comes from optocoupler U6 (FIG. 2D, FIG. 4D) into OPTO-E1 input. This information input "tells" Flyback converter 131 about the state of the voltage on capacitor C12, instructing said Flyback converter 131 to increase or decrease the voltage on said capacitor C12. In addition, Flyback converter 131 has as an output an auxiliary power RAIL of approximately 15V (e.g., 13.6V), which is used in said Flyback converter 131 and also in Phase Decode and PWM Generation stage 125. It should be noted that according to an embodiment of the present invention, the output of Flyback converter 131 is a conventional transformer-isolated, "Class II" output.

Output stage 135 is a constant current stage that receives a PWM signal from Phase Decode and PWM Generation Stage 125, where said PWM signal is transferred from Phase Decode and PWM Generation Stage 125 to Output stage 135 via optocoupler U2. Output stage 135 gets an information input from the magnitude of the voltage on constant voltage capacitor C12, when said voltage is less than 60V (it is supposed, for example, that the regulated DC voltage provided at the output of Flyback converter stage 130 is substantially 60V). Further, Output stage 135 has two outputs. The first output is the LED current output from terminals "+" and "−" (FIG. 2D, FIG. 4D), said output being chopped up or not, according to the PWM signal provided from. Phase Decode and PWM Generation Stage 125, and possibly amplitude modulated. The second output is a DC signal provided from optocoupler U6 (FIG. 2D, FIG. 4D), which feeds back to Flyback converter stage 130 the information regarding the voltage on constant voltage capacitor C12.

Figure 4A:
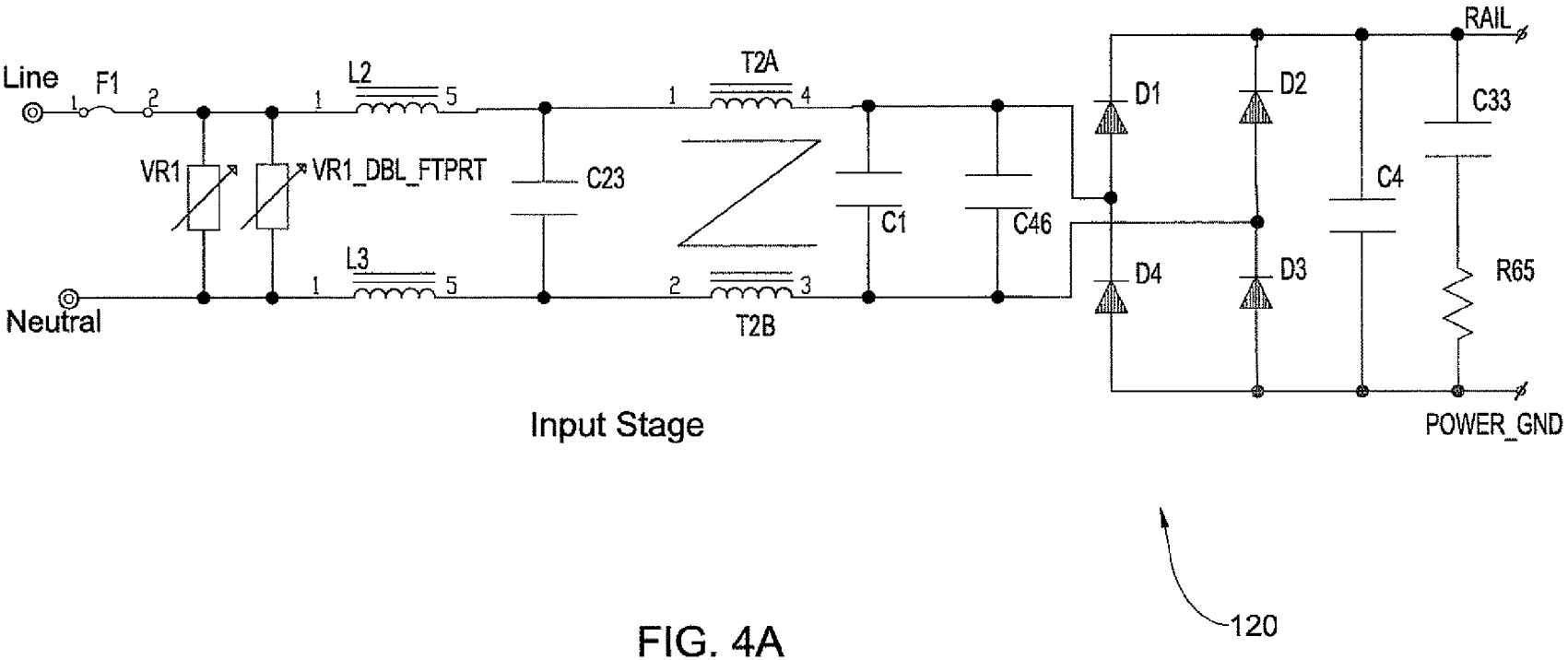
FIG. 4A is a schematic drawing of an Input stage of the phase controlled dimming LED driver, according to another embodiment of the present invention.

FIG. 2A is a schematic drawing of Input stage 120 of phase controlled dimming LED driver 110 (FIG. 1A), according to an embodiment of the present invention. FIG. 4A is a schematic drawing of Input stage 120 of phase controlled dimming LED driver 110 (FIG. 1A), according to another embodiment of the present invention. In some cases, Input stage 120 of FIG. 2A may receive an AC power input from TRIAC dimmer 105 which is in turn fed by an AC power line of 120 V and Input stage 120 of FIG. 4A may receive an AC power input from TRIAC dimmer 105 which is in turn fed by an AC power line of 240 V. In other cases Input stage 120 of FIG. 2A may receive an AC power input from TRIAC dimmer 105 which is in turn fed by an AC power line of 240 V and/or Input stage 120 of FIG. 4A may receive an AC power input from TRIAC dimmer 105 which is in turn fed by an AC power line of 120 V. Inductors L2 and L3 limit the inrush of current that would otherwise go into capacitors C23, C1 and C4, when the TRIAC component of TRIAC dimmer 105 (FIG. 1A) turns ON. It should be noted that Flyback converter 131 (FIG. 1B) extends this inrush in a relatively slight manner as a means of preventing the ringing current, which flows between inductors L2 and L3 and capacitors C23, C1 and C4, causing the current flowing from TRIAC dimmer 105 to go through a zero value. In order to damp down said ringing current, Damper 123 (FIG. 1B) that contains resistor R65 and capacitor C33 is provided. T2A and T2B constitute a common mode EMI inductor, which is a single electronic component. Inductors L3 and L2 limit differential mode currents, which flow in one wire and out the other, while the wires on said EMI inductor T2A/T2B are wound in such a way that the electromagnetic fields generated by differential mode currents cancel each other out. If a current attempts to flow in through terminals "1" and "2" of EMI inductor T2A/T2B simultaneously (which means that there is another way out of the Input stage 120 circuit for the current to flow, even if it is only capacitive coupling), then the relatively large inductance of EMI inductor T2A/T2B limits said current. In addition, varistor VR1 limits the input voltage to cope with lightning-induced voltage surges and other brief transient surges, which are usually present on conventional AC power lines. Further, capacitors C23 and C1 are "X caps" capacitors. They operate in conjunction with inductors L2, L3 and EMI inductor T2A/T2B to provide a shorting path for relatively high frequency voltages, which might otherwise go out of the Input stage 120 circuit and pollute the power lines. The magnitude of these capacitors needs to be minimized, since when the TRIAC component of TRIAC dimmer 105 turns ON, the resulting sharp rise in voltage abruptly charges them, causing a relatively high current surge.

Diodes D1 to D4 define a conventional full bridge Rectifier 122 (FIG. 1B), which converts incoming sine waves to pulsating DC voltage signals, which in turn are stored and smoothed by means of capacitor C4. As mentioned above, resistor R65 and capacitor C33 define Damper 123 (FIG. 1B), for damping down the ringing current, which flows between inductors L2 and L3 and capacitors C23, C1 and C4.

It should be noted that the undesirable resonance of the Input stage 120 circuit can be associated with charging capacitors C23, C1, and C4 through inductors L2, L3 and through a relatively small inductor, which is usually provided within TRIAC dimmer 105. These capacitors C23, C1 and C4 may become overcharged, and then they start discharging back through said inductors that can cause a reversal of the power line current, which in turn may turn OFF the TRIAC component of TRIAC dimmer 105. Thus, capacitor C33 has a relatively big capacitance compared to the capacitances of those other capacitors (e.g. C33 capacitance of 0.22 μF or 0.47 μF, i.e., around five times bigger than the largest of those capacitances). In addition, providing resistor R65 enables limiting capacitor C33 charging, so that it is still charging up, when all the other capacitors of Input stage 120 have finished charging. As a result, according to an embodiment of the present invention, the input current is not reversed, and the TRIAC component stays switched ON (remains stable).

Figure 2B:
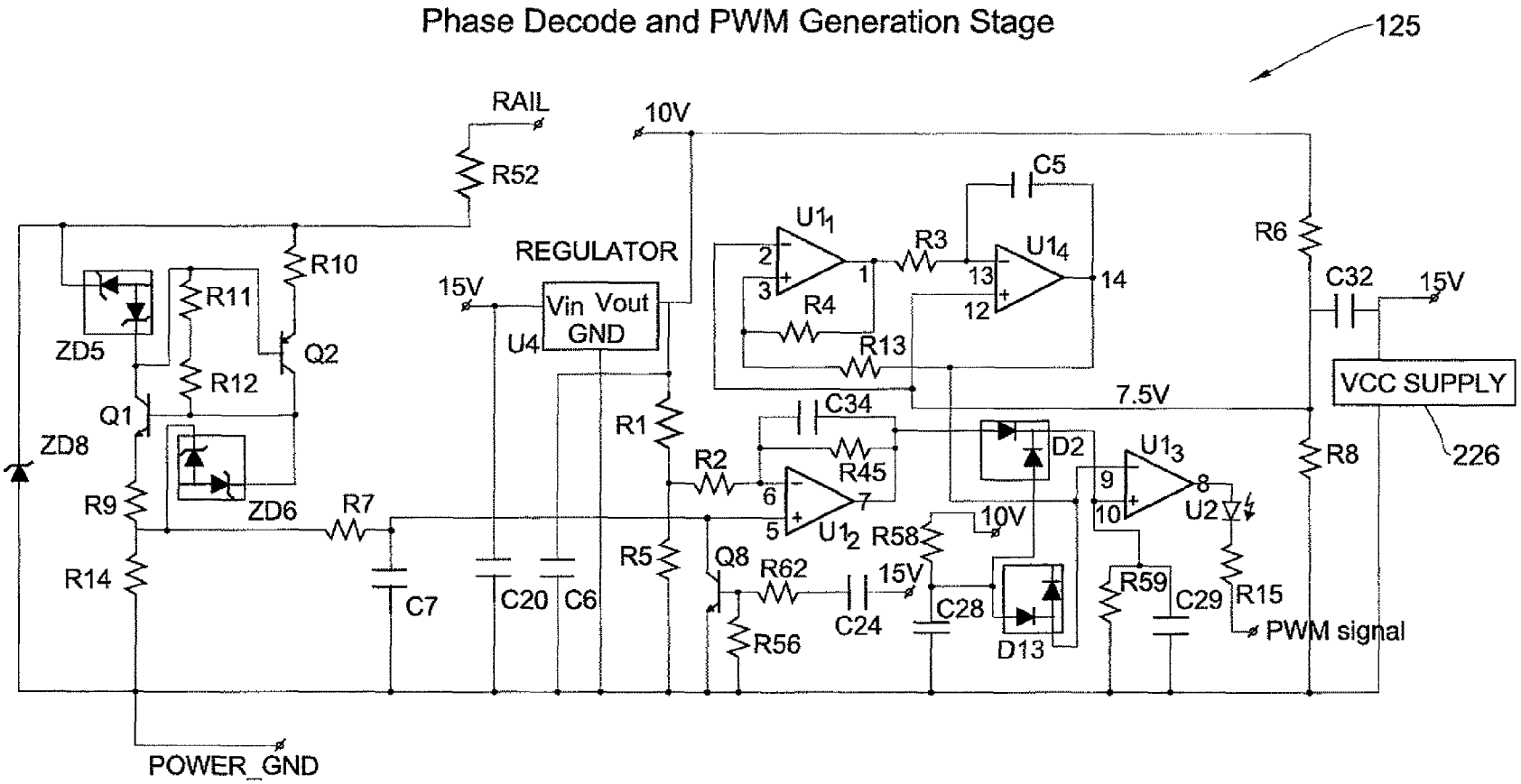
FIG. 2B is a schematic drawing of a Phase Decode and PWM Generation stage of the phase controlled dimming LED driver, according to an embodiment of the present invention.
Figure 4B:
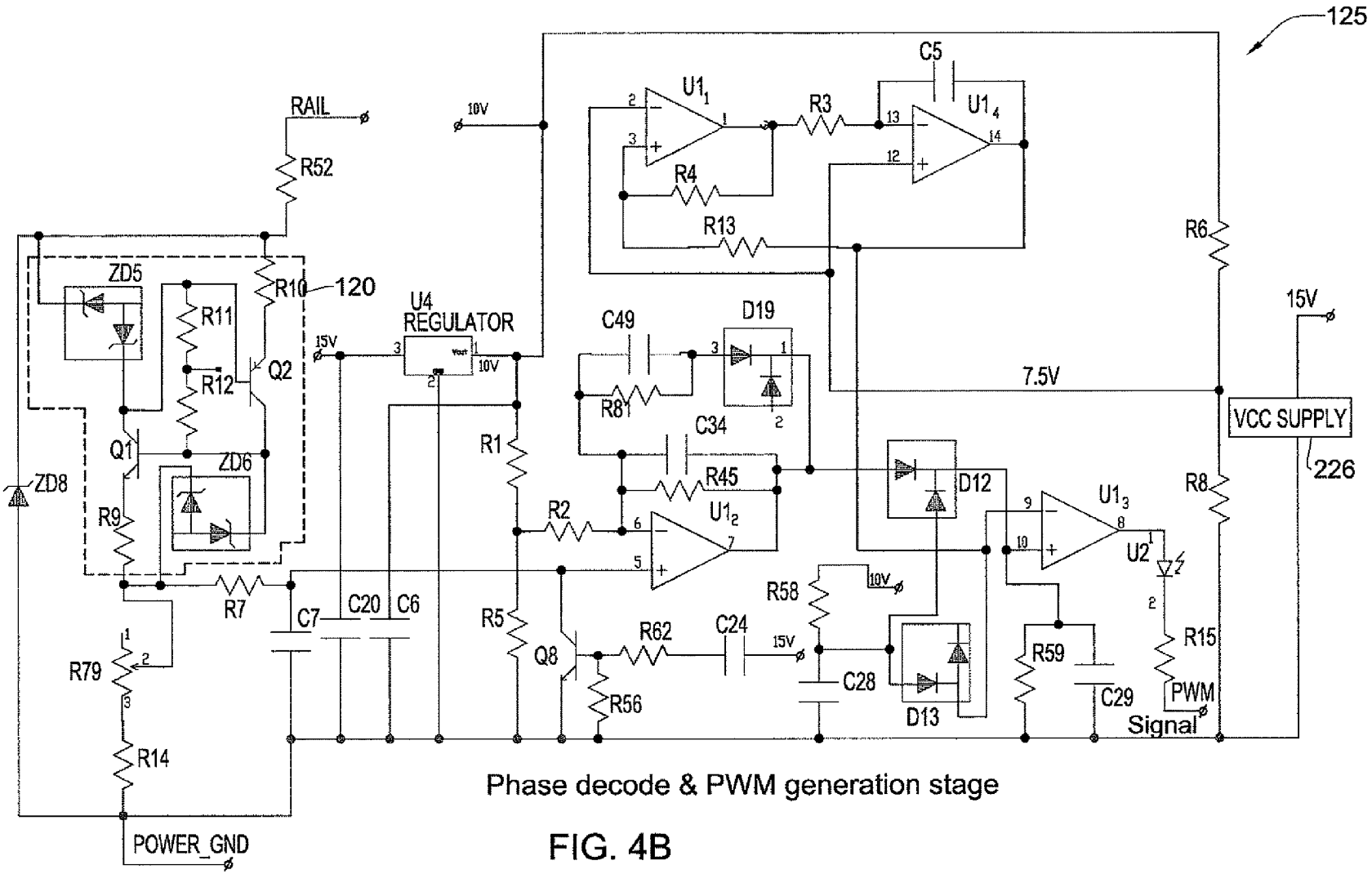
FIG. 4B is a schematic drawing of a Phase Decode and PWM Generation stage of the phase controlled dimming LED driver, according to another embodiment of the present invention.

FIG. 2B is a schematic drawing of Phase Decode and PWM Generation stage 125 of phase controlled dimming LED driver 110 (FIG. 1A), according to an embodiment of the present invention. FIG. 4B is a schematic drawing of Phase Decode and PWM Generation stage 125 of phase controlled dimming LED driver 110 (FIG. 1A), according to another embodiment of the present invention. For example, in some cases the Phase Decode and PWM Generation Stage of FIG. 2B corresponds to the Input stage of FIG. 2A, and the Phase Decode and PWM Generation Stage of FIG. 4B corresponds to the Input stage of FIG. 4A, whereas in other cases the Phase Decode and PWM Generation Stage of FIG. 2B corresponds to the Input stage of FIG. 4A, and/or the Phase Decode and PWM Generation Stage of FIG. 4B corresponds to the Input stage of FIG. 2A. According to embodiments illustrated in FIGS. 2B and/or 4B, the Phase Decode and PWM Generation stage enables sensing the position of an adjusting means (e.g. slider) on TRIAC dimmer 105 (FIG. 1A) (the slider position indicates a level of desirable light illumination), and enables outputting a PWM control signal to Flyback converter stage 130 and to Output stage 135, while said PWM control signal is substantially independent of the voltage being provided from said TRIAC dimmer 105 into Input stage 120.

It should be noted that a portion 220 of Phase Decode and PWM Generation stage 126 circuitry, containing transistors Q2 and Q1, zener diodes ZD5 and ZD6, and resistors R11, R12, R10 and R9, is a conventional floating, two terminal network circuit, which requires no external power or bias to function as a current limiter. It can be assumed, for example, that a small current is flowing through the reverse biased half of zener diode ZD5. This will produce a voltage, for example 3.3V (this voltage is desirably kept relatively small, but cannot be any lower because conventional zener diodes of lower voltage become relatively leaky), which is applied across the emitter base of transistor Q2. Resistor R10 limits the current which flows, and as a result, roughly constant current flows out of the collector of transistor Q2, corresponding to the zener diode ZD5 voltage that is applied across said resistor R10. The forward biased half of zener diode ZD5 is used for temperature compensation, and it compensates for the presence of the emitter base junction of transistor Q2. When the substantially constant collector current is outputted from transistor Q2, this current goes through the reverse biased half of zener diode ZD6 and biases transistor Q1, similarly to biasing transistor Q2. As a result, transistor Q1 has a substantially constant collector current, which in turn biases zener diode ZD5. Also, it should be noted that resistors R11 and R12 (which can be high voltage 10 MΩ [MegOhm] resistors) enable providing a relatively tiny leakage current for initiating operation of said portion 220 of circuitry. Further, it should be noted that said portion 220 of circuitry is connected to the AC power line by means of terminal RAIL, and it may be exposed to voltage surges, which can even be 600V, for example. Thus, in order to protect it against such voltage surges, a high voltage resistor R52 of 4.7KΩ is placed in series with said current limiter 220 and a surge protecting zener diode ZD8 (e.g., 400V surge protecting diode) is placed across it.

The above described portion 220 of Phase Decode and PWM Generation stage 126 circuitry generates a substantially constant current of 1 mA [milliAmpere], when applying voltages from 5V to 600V to Dimming LED driver circuit 110. The purpose of providing said substantially constant current is that whenever the TRIAC component (provided within TRIAC dimmer 105 (FIG. 1A)) is switched ON, then the value of the applied voltage is relatively high. On the other hand, when the TRIAC component is switched OFF, a value of the applied voltage is close to zero. The above substantially constant current of 1 mA flows through resistor R14 in FIG. 2B, or through resistor R14 and trimpot R79 in FIG. 4B. Assuming that resistor R14 has a resistance for example of 1 KOhm, or the series of resistor R14 and trimpot R79, has a resistance value for example of about 3 KOhms, a generating voltage of about 1 V is enabled on said resistor R14 or a generating voltage of about 3 V is enabled on said series of R14 and trimpot R79 when the current is flowing. In addition, this voltage is limited by resistor R7 and is accumulated by capacitor C7, which both enable obtaining a time constant of approximately 1 second. It should be noted that, obtaining a relatively long time constant (by adjusting values of said resistor R7 and capacitor C7) can ensure minimizing noise at 120 Hz, which is an ongoing issue in such a type of electronic circuitry, such as Dimming LED driver circuitry 110. According to an embodiment of the present invention, voltage across C7 is an analog signal, which is proportional to the fraction of the time that the TRIAC component (unit) is switched on, thus representing the position of a slider of TRIAC dimmer 105, without respect to the AC power line voltage. The position of said slider that corresponds to the full light intensity (brightness) leads to obtaining approximately 1 or 3 V on capacitor C7; on the other hand, the position of said slider that corresponds to the minimum light intensity gives approximately zero volts on said capacitor C7.

According to an embodiment of the present invention, trimpot (potentiometer) R79 includes a linear dimming control pin connected directly to a resistor, thereby enabling fine-tuning of the resistance of trimpot R79. Fine-tuning the resistance of R79 (and therefore the resistance of the series of resistor R14 and trimpot R79) adjusts the onset point of dimming with respect to the dimmer adjusting means position (e.g. slider position). In another embodiment, a linear dimming control pin may be additionally or alternatively connected to a capacitor, in order to fine-tune the capacitance and thereby adjust the onset point of dimming with respect to the dimmer adjusting means position. For example, assume there are a plurality of systems 100, each including a TRIAC dimmer 105, a dimming driver 110 and a load 115 (FIG. 1A). In some cases, in order to perform any necessary fine-tuning, e.g. at the factory, the slider of each TRIAC dimmer may be positioned to correspond to a certain low light intensity, for instance 1% dimming level. After such positioning, the light intensities of the light sources at all loads 115 may or may not appear to be the same or sufficiently similar. The light intensities may in some cases not appear to be the same or sufficiently similar because of any reason, such as mismatched components. Assuming the light intensities of the light sources at all loads 115 do not appear to be the same or sufficiently similar, trimpot(s) R79 (and/or variable capacitor(s)) in any of the dimming driver(s) 110 may be fine-tuned in order to adjust the corresponding onset point(s) of dimming so as to obtain light intensities of the light sources at all loads 115 which are the same or sufficiently similar. For example, sufficiently similar may refer to a situation where the light intensity of each light source at a certain low dimming level (e.g. 1%) is within a predetermined percentage of the average light intensity for all the light sources, e.g. within 10%. For instance, assuming Phase Decode and PWM Generation stage 126 includes the series of resistor R14 and trimpot R79, if the light intensity of each light source at a particular load appears as stronger than the light intensities of light sources at the other loads, the particular trimpot R79 which corresponds to that particular load may be adjusted so that the resistance of the corresponding particular series of resistor R14 and trimpot R79 is reduced compared to the resistance of the other series. In some cases, the reduction in resistance and subsequently in voltage for the particular series, will reduce the light intensity that is outputted in operation for a given low intensity level slider position, but will not affect or not affect as much the light intensity that is outputted in operation for full bright or for a given medium or high intensity level slider position. In some cases, even if in operation the number of light sources at the particular load is varied from the number used when performing the fine-tuning, there will still be a reduction in light intensity for the given low intensity level slider position.

According to an embodiment of the present invention, the voltage signal across C7 (for example being substantially within the range of 0V-1V or 0V to 3V as explained above) can be used to control the width of a PWM signal to be applied to constant current Output stage 135 (FIG. 1B). A portion of Phase Decode and PWM Generation stage 126 circuitry, which generates said PWM signal, is operated by the approximately 15V signal, which is assumed to be 13.6V signal, for example. To interface with said portion of circuitry, the above 1V or 3V signal needs to be amplified up to a voltage level of about 12V. This can be done by using a conventional DC operational amplifier $U1_2$. The amplification gain is determined by the ratio of resistors R45 and R2, which are connected to said amplifier $U1_2$. Also, providing resistors R1 and R5 (connected to said resistor R2) allows the input of $U1_2$ to have the voltage value slightly above zero. In this way, the control signal from capacitor C7 is converted into a signal, which ranges between zero and 12V DC, at output terminal 7 of $U1_2$.

According to an embodiment of the present invention, PWM generation circuit of Phase Decode and PWM Generation stage 126 operates with applying a positive voltage of 13.6V to Vcc Supply 226; applying substantially zero voltage on terminal 11 of said Vcc Supply 226; and applying a reference signal of approximately 7V (e.g., 7.5 Volts) to terminal 2 of amplifier $U1_1$ and to terminal 12 of amplifier $U1_4$, said reference signal is generated by using a potential divider (consisting of resistors R6, R8) of an input 10V voltage. It should be noted that capacitor C20 makes said 13.6V voltage signal substantially noise free, similarly to capacitor C6 which makes 10V voltage signal (generated by precision regulator U4) substantially noise free. As a result, the noise from the PWM generation circuit is substantially removed, eliminating undesirable fluctuations of light generated by the LED load 115 (FIG. 1A), to which said noise is usually converted.

According to an embodiment of the present invention, amplifier $U1_1$ has mostly positive feedback through resistor R4. Therefore, if the voltage outputted from terminal 1 of said amplifier $U1_1$ is relatively high, then the voltage value of its input terminal 3 is also relatively high compared to the half way point voltage on its other input terminal 2. It should be noted that since the output terminal 1 of amplifier $U1_1$ is provided with a substantially constant high voltage, the current flows through resistor R3 into terminal 13 of amplifier $U1_4$, which is configured as an integrator. Because terminals 12 and 13 of amplifier $U1_4$ need to stay at the same voltage potential, the output terminal 14 of amplifier $U1_4$ ramps down at a rate such that the displacement current flowing through capacitor C5 substantially eliminates the current flow through resistor R3. Further, the output from terminal 14 of integrator $U1_4$ is applied through resistor R13 to terminal 3 of amplifier $U1_1$. This means that a relatively small portion of the terminal 14 voltage is being applied to said terminal 3 (the voltage on terminal 3 of amplifier $U1_1$ is not entirely locked to the voltage on terminal 1 of said amplifier $U1_1$, since the signal through resistor R13 can pull it around). As the voltage on terminal 14 of integrator $U1_4$ starts decreasing, the voltage on terminal 3 of amplifier $U1_1$ is pulled down below the reference voltage (e.g., 7V) provided into terminal 2. Then, amplifier $U1_1$ flips state with pin 1 switching to its limiting low voltage output. This leads to the linear increase of terminal 14 voltage, until the voltage on terminal 3 is pulled above said reference voltage. After that, the voltage on said terminal 3 is pulled down again, repeating these steps.

It should be noted that terminal 1 of amplifier $U1_1$ outputs a square wave signal with 50% duty cycle that has, for example, amplitude in a range of substantially 0.6V and 13.0V. On the other hand, terminal 14 of integrator $U1_4$ outputs a waveform, which linearly ramps in a range between high and low voltages (such as 1.0V and 12.6V), wherein said range is predefined by values of resistors R4 and R13. It should be noted that the waveform outputted from integrator $U1_4$ first ramps up to the high voltage and then ramps down to the low voltage, and after that it is repeated over again. The frequency of said waveform is predefined by the time constant set according to values of capacitor C5 and resistor R3. It should be noted that capacitor C5 can be made of a temperature stable material, such as COG (It should be noted that in the COG abbreviation, defined by the American Electronics Association, the first letter ("C") defines the minimum operating temperature, the second letter ("O") defines the maximum operating temperature, and the third letter ("G") defines the percentage change in capacitance when applying the above maximum and minimum operating temperatures.) Also, for minimizing effects of undesirable tiny leakage currents, said capacitor C5 can have a relatively large capacitance, such as 4700 pF [picoFarad].

According to an embodiment of the present invention, the pedestal voltage outputted from terminal 7 of amplifier $U1_2$ is used in conjunction with the ramp voltage provided from terminal 14 of integrator $U1_4$ to generate a PWM signal to be outputted from Phase Decode and PWM Generation stage 126. For this, comparator $U1_3$ is used for producing a PWM signal train. A problem may be raised, when the pedestal voltage is relatively low and is close to minimum, such as 1V. In such a case, the pedestal voltage clips the bottom tips of the ramp waveform. As a result, even if relatively slight noise or irregularity is present on terminal 7, then such noise is amplified, resulting in reducing the light illumination intensity in a manner, which the human eye interprets as an annoying flickering. For this reason, according to an embodiment of the present invention, it can be undesirable to pulse width modulate a signal down to substantially zero voltage amplitude because usually the last few percent (e.g., 5%) of the signal voltage are noisy, which in turn can produce undesirable light flickering, in terms of human perception. Therefore, according to an embodiment of the present invention, the pulse width modulation of a signal outputted from terminal 7 of comparator $U1_3$ can be stopped at a predefined level, for example, at 8% of its full width. As mentioned above, pulse width modulating the signal below this predefined level may generate the undesirable noise, and in turn light flickering. However, it should be noted that the minimum ramp voltage outputted from terminal 14 of integrator $U1_4$ can be affected by temperature changes, operational amplifiers gains and offset voltages, and other various factors. Therefore, said minimum terminal 14 ramp voltage is recorded as follows: capacitor C28 is charged up by resistor R58 from the steady 10V voltage terminal, connected to said resistor R58. Bipolar diode D13 is connected to terminal 14 of integrator $U1_4$, so that each time the voltage of the ramp waveform (outputted from said terminal 14) goes below the capacitor C28 voltage, said capacitor C28 is discharged and is maintained at 0.7V above the minimum voltage of said ramp waveform.

According to an embodiment of the present invention, in order to generate a PWM signal, amplifier $U1_3$ (that operates as a comparator) is presented with the ramp waveform on its input terminal 10. Then, its other input terminal 9 is presented with the higher voltage than the voltage of said terminal 7 or than the voltage on capacitor C28. Diodes D12 (e.g. Schottky) are used to implement the "OR" function, and if it is assumed that they have a forward voltage of 0.3V, then the minimum voltage that is presented to terminal 9 of comparator $U1_3$ is the minimum ramp voltage, such as a voltage in a range from 0.3V to 0.7V. In addition, it should be noted that in spite of the fact that diodes D13 and D12 can have different temperature coefficients, the output PWM signal remains substantially stable as long as the value of capacitor C28 is minimized (e.g., it has a capacitance of 1 μF). Further, resistor R59 and capacitor C29 are connected to terminal 10 of comparator $U1_3$ to set a relatively long time constant (~1 sec) to the terminal 10 voltage, so that the noise can be maximally reduced. As a result, when the slider of TRIAC dimmer 105 is moved down, the output PWM signal from Phase Decode and PWM Generation stage 125 narrows the output current (provided into LED load 115) to a level of about 8%, for example. It should be noted that the PWM signal is substantially noise free.

According to an embodiment of the present invention, the voltage which comes out of terminal 8 of comparator $U1_3$ is a PWM signal having, for example, a 12V amplitude, which has a width proportional to the capacitor C7 voltage, but which narrows down, for example, to approximately 8% pulse width regardless of how small a duty cycle of the TRIAC component (provided within TRIAC dimmer 105) goes down to. This PWM signal is applied through optocoupler U2 to output stage 135 (FIG. 1B). As a result, when the slider of TRIAC dimmer 105 is moved down, the pulse width of the output current goes down substantially smoothly until about 8%, and then it stays at this level, regardless of how low said slider is moved down. This prevents possible light flickering. It should be further noted that another issue can be adjusting values of resistors R4, R13 and R45, so that when TRIAC dimmer 105 outputs a maximal voltage signal (e.g., 115 Volts for 120 V line voltage or 230 Volts for 240 V line voltage) into Input stage 120, the voltage on output terminal 7 of amplifier $U1_2$ will remain above the maximum voltage of the ramp waveform provided from terminal 14 of integrator $U1_4$. This means that when the slider of TRIAC dimmer 105 is moved down, at first there is no response, and then there can be a linear progression, for example, down to 8%, and after that once again there can be no response. This allows using different types of TRIAC dimmers that can have different maximum output voltages, for example, in a range from 95V to 115V for 120V TRIAC dimmers (the minimum output voltage of conventional TRIAC dimmers usually varies from 35V to 4V) or for example in a range of 200 V to 230 V for 240V TRIAC dimmers (the minimum output voltage of conventional 240V TRIAC dimmers usually varies from 70V to 30V). Therefore, according to an embodiment of the present invention, the output voltage/current signal achieved with each TRIAC dimmer starts off at the 100% setting and as the slider of said each TRIAC dimmer is moved down, the output pulse width voltage/current signal goes down to 8%, regardless of the TRIAC dimmer type.

It should be noted that, when a TRIAC component within conventional TRIAC dimmer 105 turns ON, it may turn ON momentarily at full voltage, even when a dim level is set. Thus, a problem can arise when the current limiter circuit (defined by zener diodes ZD5, ZD6, transistors Q1 and Q2, and resistors R9 to R12) is exposed to this full voltage burst and charges up capacitor C7 correspondingly, so as a result dimming LED driver 110 (FIG. 1A) can start up with a bright light flash, even when the TRIAC dimmer 105 slider is set to the full dim. According to an embodiment of the present invention, this issue can be substantially resolved by adding transistor Q8 in Phase Decode & PWM generation stage 125. The base of transistor Q8 is driven by capacitor C24 connected to the normally stable 15V voltage terminal. This means that only when said 15V voltage is rising, transistor Q8 is turned ON and discharges capacitor C7, so that said capacitor C7 initiates a normal operation from substantially zero voltage. In addition, it should be noted that capacitor C24 has relatively large capacitance, and its discharge is limited by resistor R62, so that it continues to hold down the capacitor C7 voltage for some predefined period of time.

Figure 2C:
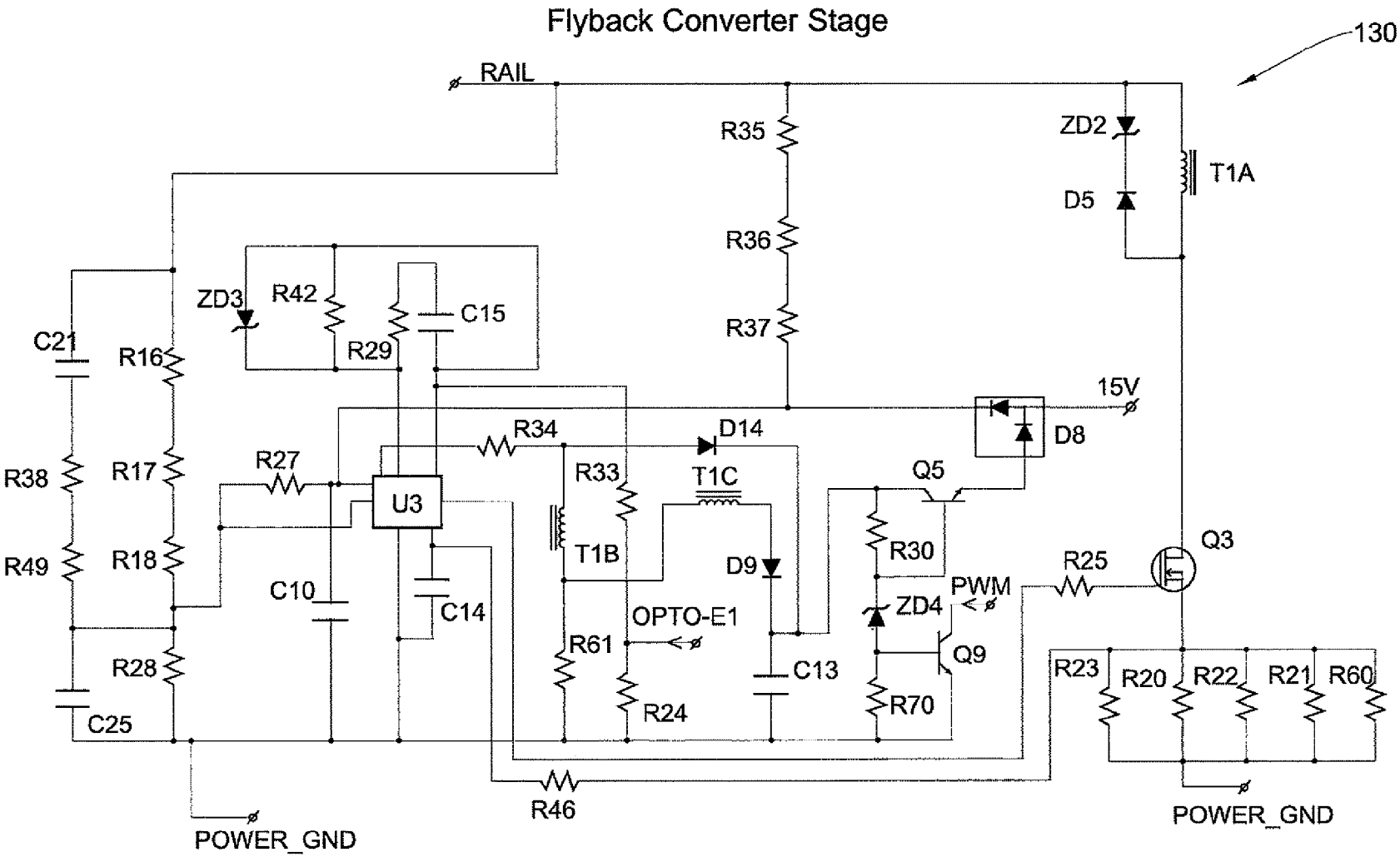
FIG. 2C is a schematic drawing of a Flyback converter stage of the phase controlled dimming LED driver, according to an embodiment of the present invention.
Figure 2D:
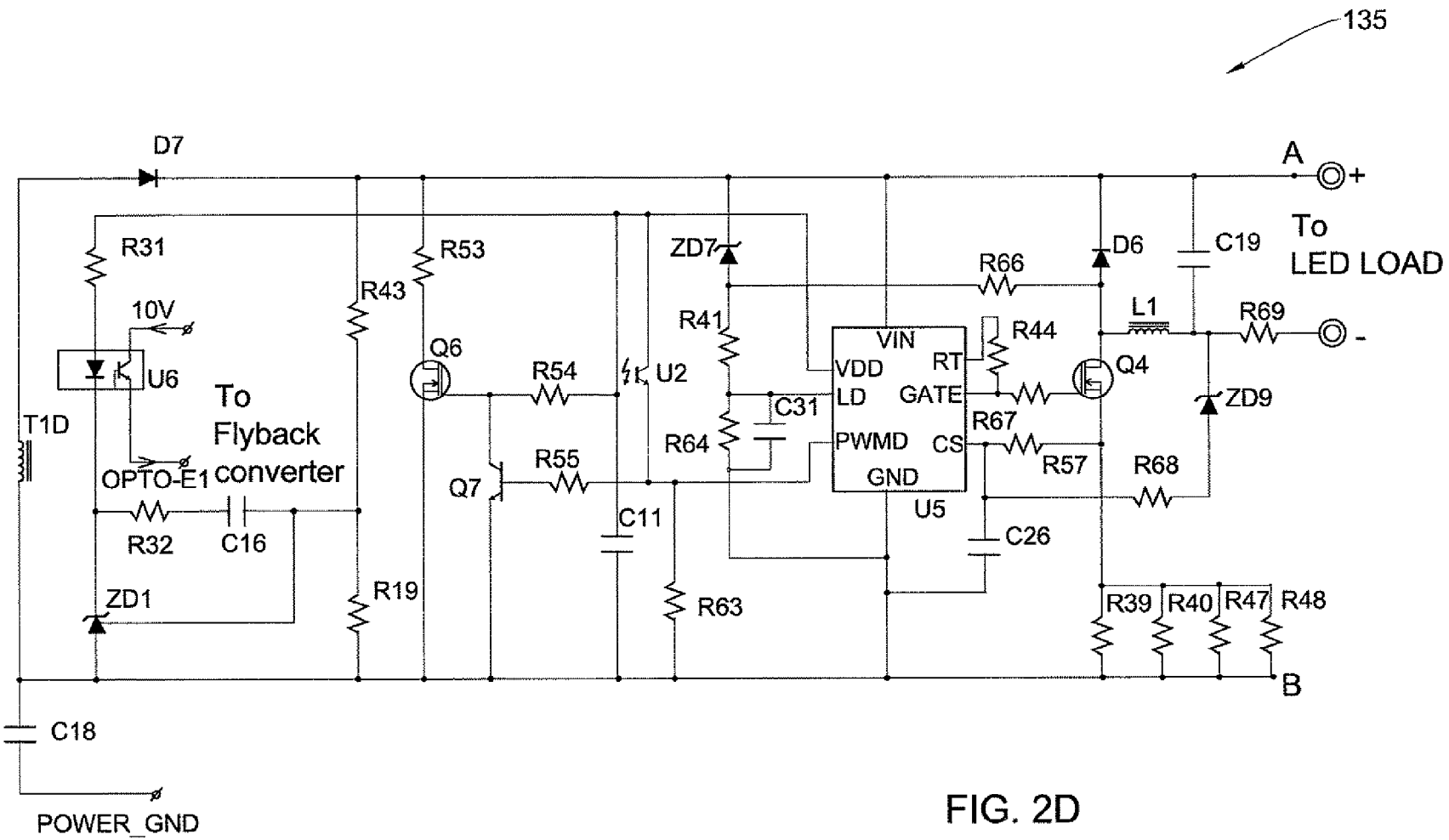
FIG. 2D is a schematic drawing of an Output stage of the phase controlled dimming LED driver, according to an embodiment of the present invention.
Figure 4C:
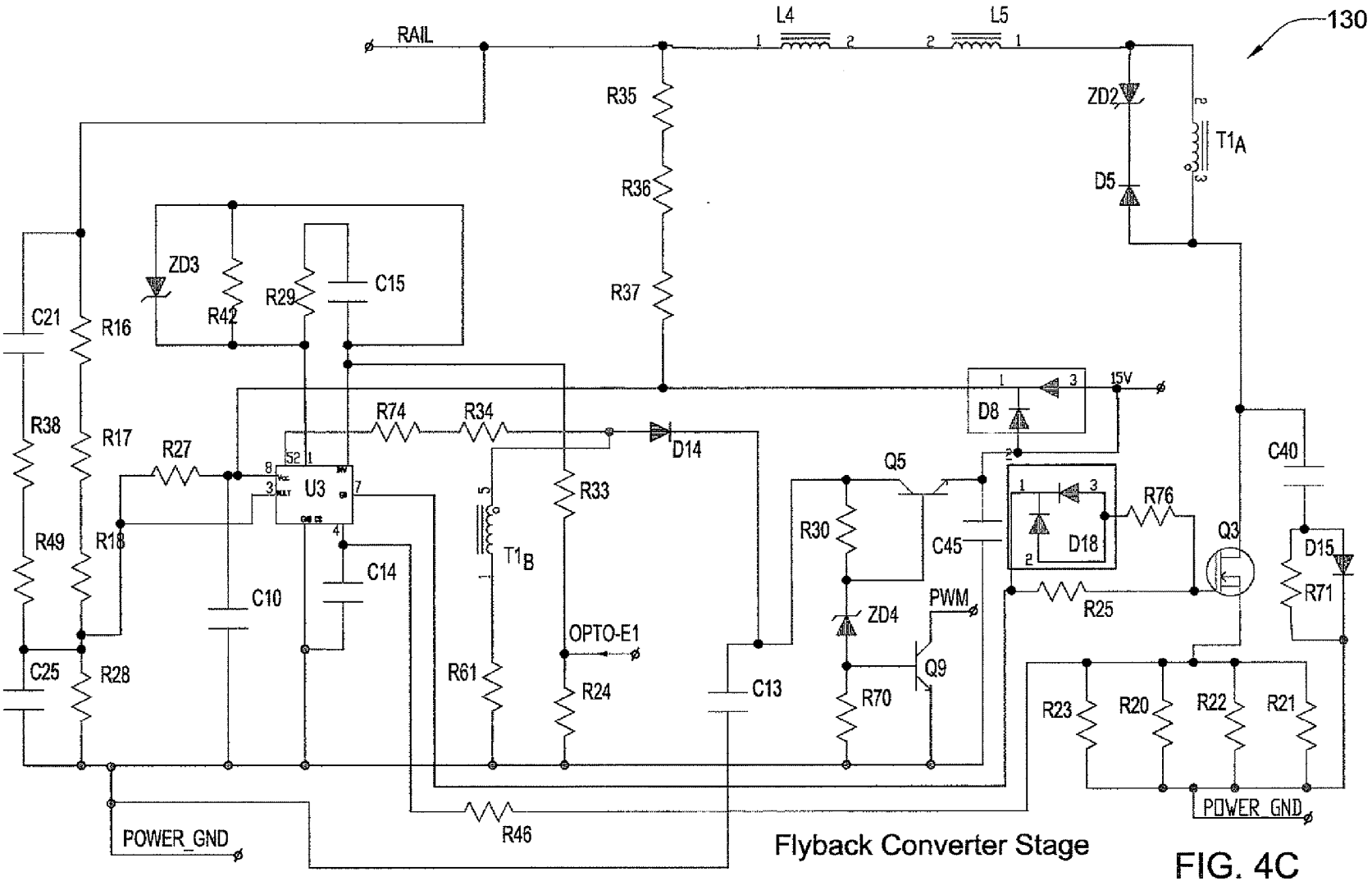
FIG. 4C is a schematic drawing of a Flyback converter stage of the phase controlled dimming LED driver, according to another embodiment of the present invention.
Figure 4D:
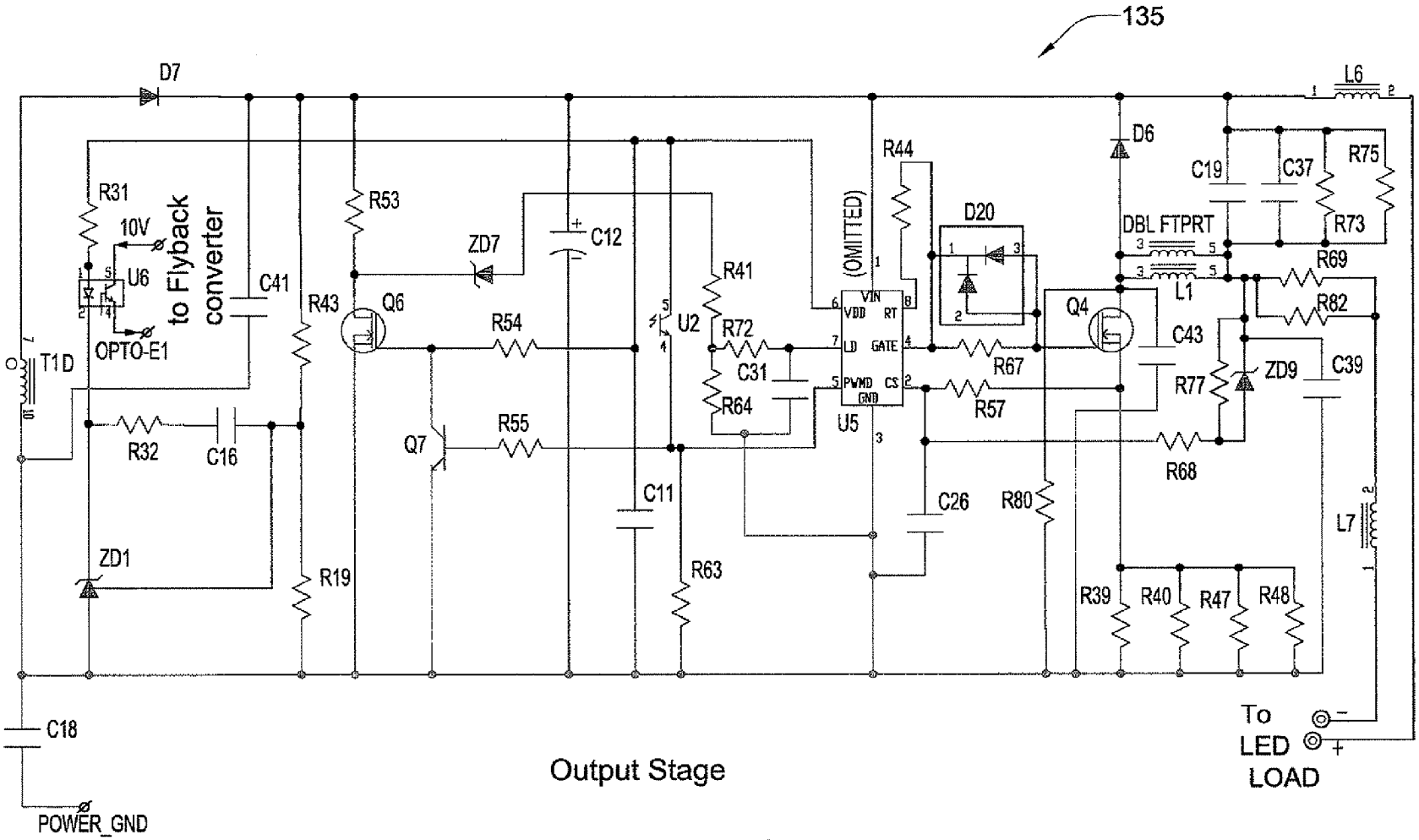
FIG. 4D is a schematic drawing of an Output stage of the phase controlled dimming LED driver, according to another embodiment of the present invention.

FIG. 2C is a schematic drawing of Flyback converter stage 130 of phase controlled dimming LED driver circuit 110 (FIG. 1A), according to an embodiment of the present invention. FIG. 4C is a schematic drawing of Flyback converter stage 130 of phase controlled dimming LED driver circuit 110 (FIG. 1A), according to another embodiment of the present invention. For example, in some cases the Flyback converter Stage of FIG. 2C corresponds to the Input stage of FIG. 2A, and the Flyback converter Stage of FIG. 4C corresponds to the Input stage of FIG. 4A, whereas in other cases the Flyback converter Stage of FIG. 2C corresponds to the Input stage of FIG. 4A, and/or the Flyback converter Stage of FIG. 4C corresponds to the Input stage of FIG. 2A. According to embodiments illustrated in FIGS. 2C and/or 4C, the Flyback converter receives a pulsating DC RAIL input from Input stage 120. It should be noted that regardless of the level of a dimming phase control, according to which the TRIAC component of TRIAC dimmer 105 chops up the AC waveform provided into Input stage 120, the Flyback converter generates a substantially smooth and highly regulated DC voltage on constant voltage capacitor C12 (FIG. 2D, 4D). It should be noted that the output voltage of said Flyback converter 131 is isolated from its input and is a conventional transformer-isolated, "Class II" output (T1 transformer (T1A, T1B, T1C [FIG. 2C only] and T1D (FIG. 2D, 4D)) is a flyback transformer).

According to an embodiment of the present invention, an information input to Flyback converter stage 130 is provided from optocoupler U6 (FIG. 2D, 4D) into OPTO-E1 input. This information input "tells" the Flyback converter about the state of the voltage on capacitor C12 (FIG. 2D, 4D), instructing the Flyback converter to set said voltage higher or lower. In addition, the Flyback converter has as an output of approximately 15V (e.g., 13.6V) auxiliary power.

According to an embodiment of the present invention, the input pulsating DC RAIL voltage of the Flyback converter may be, for example, only 4V RMS instead of the normal 120V RMS or for example only 10 V RMS instead of a normal 240V, thereby enabling deep dimming (e.g., up to 0.1% of the full light intensity). For this, Flyback converter stage 130 may have any of the following features.

To accommodate relatively low input voltage (e.g., 4V or 10 V RMS) means that in a fraction of a millisecond, when the TRIAC component is ON, Flyback converter circuit 130 has to be capable of receiving a larger current than can be normally expected. This can be mainly enabled by providing resistors R23, R60 (FIG. 2D only), R20, R22, and R21, connected in parallel and having, for example, an overall corresponding resistance value of only 0.2Ω or 0.7Ω. The lower such an overall value is, the higher is the surge current capability of Flyback converter circuit 130. Also, FET (Field Effect Transistor) transistor Q3 can be, for example, an 11 A capability component, being able to handle relatively large currents or for example a 2 A capability component if not necessary to handle as large currents.

When operating at full dim, the auxiliary power capacitor C13 has to be charged up for a short period of time, for example, for less than 5% of time compared to charging of other capacitors of Flyback converter stage 130. For this, capacitor C13 has to be a relatively big capacitor, for example 47 μF [microFarad]. In addition, said capacitor C13 is charged from both inductors T1B and T1C through diodes D14 and D9, respectively in the Flyback converter of FIG. 2B. Thus, capacitor C13 is recharged twice per cycle, which ensures that said capacitor C13 remains charged when operating at full dim. In the Flyback converter of FIG. 4B said capacitor C13 is instead charged from inductor T1B through diode D14, once per cycle.

Since the output voltage of the auxiliary power is normally 13.6V, then providing a voltage of 20V on capacitor C13 and using a voltage regulator, consisting of transistor Q5 and zener diode ZD4, to provide the 13.6V, works substantially well. However, when operating at full dim, the voltage on said capacitor C13 tends to fall, which in turn leads to having ratios of inductors T1A, T1C (FIG. 2B only), and T1B set so that the normal full power voltage on capacitor C13 is about 50V. Thus, according to an embodiment of the present invention, transistor Q5, capacitor C13, and diodes D9 (FIG. 28 only) and D14 have to be constructed of higher voltage capability materials to withstand possible voltage and power stress.

When the TRIAC component of TRIAC dimmer 105 switches ON, then there can be a relatively large inrush of current, which charges up both an internal inductor of TRIAC dimmer 105 and input inductors L2 and L3 (FIG. 2A, 4A). In turn, these inductors may lead to the undesirable generation of ringing current, when "X caps" C23, C1 and C4 (FIG. 2A, 4A) start discharging. To prevent this, resistors R38 and R49 are connected in series to capacitor C21. When the TRIAC component switches ON, the resulting sharp rise in voltage causes capacitor C21 to conduct displacement current, which goes into terminal 3 of the power factor correction (PFC) chip U3 (e.g., Transition-mode PFC controller chip L6562, manufactured by STMicroelectronics® company). The time constant of resistors R38 and R49 together with capacitor C21 is set to be similar to the time period of the anticipated current ringing. Thus, after an inrush surge, extra current from capacitor C21 continues to flow into terminal 3 of PFC chip U3, which commands it to pull a momentary extra current from the AC power line, just at the moment when the ringing would have been reducing the AC line current to zero and causing the TRIAC component to cut out and go unstable. The result is that because of this extra input current that is commanded, the negative going excursion of the ring is cancelled out. As with all the input current controlled by PFC chip U3, the momentary extra input current produces charge on capacitor C12 (FIG. 2D, 4D), which (said charge) becomes available to be used for generating light by LED load 115. Capacitor C25 serves to delay the momentary extra burst of current until after the original inrush pulse is completed.

It should be noted that resistor R27 provides a constant current into terminal 3 of PFC chip U3, which commands it to keep running even when the TRIAC is switched off. This discharges the X caps when the TRIAC component is not conducting (is turned OFF). This makes it possible for the current source circuit of Q1 and Q2 (current limiter circuit 220 (FIG. 2B, 4B)) to produce a signal which reflects the position a slider of TRIAC dimmer 110 (FIG. 1A), without blurring that would otherwise be caused by residual charge on the X caps of phase controlled dimming LED driver circuit 110.

According to an embodiment of the present invention, it is desirable that Flyback converter stage 130 is able to start from as low an input voltage as possible in order to enable relatively deep dimming (e.g., up to 0.1% of the full light intensity). For this reason, resistors R35, R36 and R37 are set to the lowest possible values, such as 16KΩ each for operation on a 120V AC power line or 39KΩ each for operation on a 240V AC power line. This allows start up of the Flyback converter at as low a voltage as possible, subject to the limitation of power dissipation in said resistors R35, R36 and R37. Thus, as much current as possible comes through these resistors at start up, and in turn, charges capacitor C10. When the voltage on said capacitor C10 raises up to about 12V, then PFC controller U3 starts operating, and runs briefly using the energy stored on capacitor C10. On the other hand, when capacitor C10 voltage gets down to about 10V, the operation of PFC controller U3 is terminated and the whole procedure repeats about 100 μsec (microseconds) later. During this brief operation, capacitor C13 gets charged up. It may require several of these charging procedures before capacitor C13 is charged up to about 16 to 20V, at which point 15V zener diode ZD4 breaks down and transistor Q5 gets biased on, causing the current to flow through diode D8 into capacitor C10. At this point, PFC controller U3 is continuously operated and capacitor C13 becomes charged up almost instantaneously to about 45V-50V. It should be noted that amplifiers $U1_1$ to $U1_4$, and precision regulator U4 (FIG. 2B, 4B) become powered up substantially at the same moment. PFC controller U3 is regulated to generate a substantially constant voltage of 60V on constant voltage capacitor C12 (FIG. 2D, 4D). In addition, it should be noted that the voltage feedback comes in through optocoupler U6 (FIG. 2D, 4D). Whenever the RAIL voltage is too high, optocoupler U6 turns ON and pushes up the voltage on terminal 1 of PFC controller U3, which in turn causes said PFC controller to throttle back.

According to an embodiment of the present invention, in order to substantially shut down operation of system 100 (FIG. 1A) after the power is switched OFF, an undervoltage lockout (UVLO) in Flyback converter stage 130 can be implemented by placing transistor Q9 emitter-base in series with zener diode ZD4, the 15V regulator zener diode. Thus, when no current flows through said zener diode ZD4, then transistor Q9 is turned OFF (transistor Q9 operates as a switch). This undervoltage (low voltage) lockout causes the output current to cease relatively abruptly when system 100 is turned OFF. When the voltage on C13 is above 15V, transistor Q9 is switched ON and this allows the output "ON command" to be sent out to Output stage 135 through optocoupler U2 (FIG. 2D, 4D). When the 15V auxiliary power starts to fail, as the voltage on capacitor C13 drops below 15V, then transistor Q9 is turned OFF and all above "ON commands" are stopped. It should be noted that the signal provided from Phase Decode and PWM Generation stage 125 (FIG. 2B, 4B) to Output stage 135 passes through optocoupler U2 (FIG. 2B, 4B) and returns to the power ground (Power_GND) through transistor Q9.

According to an embodiment of the present invention, capacitor C13 is sized such that when the input power is turned OFF, the 15V voltage signal fails substantially immediately, thereby shutting down the operation of system 100 (FIG. 1A). Therefore, even though the output capacitor C12 (2D, 4D) may still have a relatively large amount of energy stored up, the light produced by the LEDs of LED load 115 (FIG. 1A) is shut down substantially at the moment (e.g., after 80 milliseconds), when the power switch (e.g., a slider of TRIAC dimmer 105) of system 100 is turned OFF.

According to an embodiment of the present invention, resistors R16, R17, R18 and R28 define a potential divider, which produces on terminal 3 of PFC controller U3 a reduced amplitude "image" of the incoming AC power line voltage. The multiplier circuit inside said PFC controller U3 tries to emulate this "image" in the input current, which is further drawn and sensed on its terminal 4. In other words, it tries to make the input current "mirror" the input AC power line voltage.

Further, it should be noted that diode ZD3 limits excessive voltage excursions between the inputs of the internal amplifier provided within PFC controller U3 L6562; this helps maintain stability of said PFC controller as it is turned ON.

FIG. 2D is a schematic drawing of Output stage 135 of phase controlled dimming LED driver circuit 110 (FIG. 1A), according to an embodiment of the present invention. FIG. 4D is a schematic drawing of Output stage 135 of phase controlled dimming LED driver circuit 110 (FIG. 1A), according to another embodiment of the present invention. For example, in some cases the Output Stage of FIG. 2D corresponds to the Input stage of FIG. 2A, and the Output Stage of FIG. 4D corresponds to the Input stage of FIG. 4A, whereas in other cases the Output Stage of FIG. 2D corresponds to the Input stage of FIG. 4A, and/or the Output Stage of FIG. 4D corresponds to the Input stage of FIG. 2A. According to embodiments illustrated in FIGS. 2D and/or 4D, Output stage 135 comprises a conventional LED Driver chip U5, such as Universal High Brightness LED Driver HV9910B chip (manufactured by Supertex, Inc., located in United States), which is operated at about 30 KHz. It should be noted that the HV9910B chip has a low-noise regulated 7V output on its terminal 6, which is used as the power supply for optocoupler U6 and shunt regulator ZD1. This serves to preserve the relatively high quality power factor correction by generating a relatively high quality feedback signal, substantially without any noise on it.

A conventional TRIAC component (provided within TRIAC dimmer 105) has to be provided with a certain minimum amount of current, which is required to keep it operating. When LED(s) of LED load 115 (FIG. 1A) are dimmed down, for example, to 0.1% of the full light intensity, the consumed power is not sufficient to keep said TRIAC component operating. Consequently, it is necessary to implement some power dissipation specifically to keep said TRIAC component "alive", while the power consumed by said LEDs load 115 is negligible. The PWM control signal comes in on optocoupler U2, which operates as a switch. When optocoupler U2 is turned ON, it switches ON the HV9910B U5 chip output at terminal 5. In turn, the terminal 5 signal is applied to the base of transistor Q7, so that whenever the U5 HV9910 chip is turned OFF, then also transistor Q7 is turned OFF and transistor Q6 is turned ON. The load of transistor Q6 is a relatively big resistor R53, which is capable of dissipating 1 W of power substantially without overheating. As the LED output current is phased back by the pulse width modulation, the power dissipation of said resistor R53 is gradually phased in, in an inverse manner, so that at full dim the power dissipation in R53 is almost continuous. As a result, due to said power dissipation, TRIAC component of TRIAC dimmer 105 remains "alive" and makes system 100 possible to obtain very low dimming capabilities (e.g., dimming down to 0.1% or less of the full light brightness).

According to an embodiment of the present invention, HV9910B U5 chip is used to apply amplitude modulation in addition to pulse width modulation to the output of Output stage 135 (defined by terminals "+" and "−").

In the Output stage shown in FIG. 2D, amplitude modulation begins when the output is dimmed below approximately 8%, as will now be described, meaning that there is a difference in the position of the dimmer adjusting means (e.g. slider) between the start of the pulse width modulation and the start of the amplitude modulation.

It should be noted that when the TRIAC dimmer 105 slider is being moved past the region where its output AC voltage is reduced to around 20V, the voltage on capacitor C12 remains initially constant, while the power being supplied from TRIAC dimmer 105 to dimming LED driver circuit 110 (FIG. 1A) continues decreasing. In turn, this will lead to light flickering and instability, which is undesirable. Therefore, an effective solution has to be provided. According to an embodiment of the present invention, in order to address this problem, terminal 7 on the U5 HV9910B chip can be used, which is an analog input terminal, operating for voltages from 250 mV to 0 mV [milliVolts]. Providing voltage of 250 mV and above leads to obtaining the maximal output current (e.g., current of 350 mA as required by LED load 115 to produce the light having full intensity). On the other hand, lower voltage values lead to proportionately lower currents through LED load 115.

It is assumed, for example, that the output power RAIL voltage, provided from terminal "+", is set to 60V with respect to the common negative RAIL of the output circuit (terminal "−"). Also, zener diode ZD7 can have, for example, 47V rating. As a result, the voltage on the anode of said zener diode ZD7 is 13 Volts (60V−47V=13V). According to an embodiment of the present invention, resistors R41 and R64 divide this voltage down on terminal 7 of HV9910B chip to approximately 270 mV. The flyback converter stage circuit 130 (FIG. 2C) and auxiliary power signals can keep running down to relatively low input voltages, such as 5V. When finally the output 60V voltage starts to fall because there is insufficient energy available to power the output, the voltage on terminal 7 of the U5 HV9910B chip becomes below 250 mV, which commands a proportionate reduction in the output current peak amplitude substantially simultaneously with the pulse width modulation of said current. Therefore, with the start of amplitude modulation, the value of the output current becomes more directly dependent on changes in the power line voltage supplied to dimmer 105. Capacitor C31 has a relatively large capacitance (e.g., 4.7 μF), so that the voltage applied to said terminal 7 remains relatively stable and noise from the 60V power signal is substantially not amplified. The reduction of the output current amplitude means that less power is being drawn from the 60V signal, and so the voltage of said signal does not fall so much. This constitutes a negative feedback, which in turn produces a stable output waveform, the amplitude of which reflects the smoothed voltage on capacitor C31. As a result, the diminished output current remains relatively smooth and substantially free of flicker or shimmer, for example, down to 0.1% of the full light brightness.

In FIG. 4D, the amplitude modulation begins at substantially the same time as the pulse width modulation, so that a larger percentage dimming is achieved for the same corresponding phase angle of dimmer 105 (FIG. 1A). In FIG. 4B, the cathode of zener diode ZD7 is connected to the drain of transistor Q6 (instead of to the RAIL as in FIG. 2B). As mentioned above, the PWM control signal comes in on optocoupler U2, which operates as a switch. When optocoupler U2 is turned ON, it switches ON the HV9910B U5 chip output at terminal 5. In turn, the terminal 5 signal is applied to the base of transistor Q7, so that whenever the U5 HV9910 chip is turned OFF, then also transistor Q7 is turned OFF and transistor Q6 is turned ON. Therefore, once pulse width modulation begins, the voltage across transistor Q6 is a square wave with PWM duty cycle. Because of the characteristics of the voltage across transistor Q6, the voltage on terminal 7 of the U5 HV9910B chip will almost immediately fall below 250 mV once pulse width modulation begins, and amplitude modulation will therefore begin substantially at the same time as pulse width modulation. For example, the substantially concurrent start may allow a 50% reduction in the voltage inputted into Input Stage 120 by dimmer 105 to cause in some cases a 90% reduction in the current outputted by Output stage 135 to load 115. It is noted that amplitude modulation begins even while the output power RAIL voltage remains high at 60 V, meaning that the output current is almost independent of changes in the power line voltage supplied to dimmer 105 (Nonetheless, the output current may in some cases have a much reduced linkage to such power line voltage changes, because in some cases such changes may affect dimmer 105 and driver circuit 110 responds to dimmer 105). Although this configuration (which causes pulse width modulation and amplitude modulation to begin substantially at the same time) may be used when dimmer 105 is capable of dimming down to any minimum percentage of the line voltage, this configuration may be especially advantageous when the minimum percentage is relatively high.

According to an embodiment of the present invention, when the light output is instructed to be reduced and finally turn OFF, then zener diode ZD7 turns OFF substantially cleanly. The voltage on terminal 7 of the U5 HV9910B chip is relatively abruptly reduced to zero. The resulting drop in power consumption from LED load 115 causes the output voltage to jump up a fraction of a second later. Zener diode ZD7 turns back ON, and the whole process repeats after, for example, 100 milliseconds, producing undesirable light flashing. According to an embodiment of the present invention, this can be prevented by adding 10 MΩ [MegOhm] resistor R66 as shown in FIG. 2D. This degrades the characteristics of zener diode ZD7, so that it is unable to switch OFF cleanly. As a result, the light goes out relatively smoothly. Because of the power drawn by resistor R53, the Flyback converter 131 (FIG. 1B) and the TRIAC component of TRIAC dimmer 105 (FIG. 1A) still continue operating, so that raising the slider on TRIAC dimmer 105 resumes the light output.

As is known in the art, zener diodes such as ZD7 may not always work well at low current levels, meaning that the output voltage may be noisy due to microplasmas associated with crystal defects. In the case of zener diode ZD7, it would not be desirable to pass such noise to terminal 7 of the U5 HV9910B chip since such noise could cause spurious variations in the output current. According to an embodiment of the present invention, the current through zener diode ZD7 may be raised by lowering the impedance level of resistors R41 and R64. In Output stage 135 illustrated in FIG. 4B, the resistance R72 separates the impedance level associated with the RC time constant of capacitor C31 and resistor R72 from the impedance levels of resistors R41 and R64. Therefore, in Output stage 135 illustrated in FIG. 4B the impedance level of resistors R41 and R64 may be lowered in order to raise the current through zener diode ZD7, and there may still be a long time constant to smooth the signal on terminal 7 of the U5 HV9910B chip without requiring an expensive capacitor with relatively large capacitance for C31.

According to an embodiment of the present invention, resistors R39, R40, R47 and R48 define the output current. Each time transistor Q4 is switched ON, the current rises until a preset critical voltage is obtained across these resistors. Then, transistor Q4 is switched OFF again for a predetermined period of time predefined by resistor R44. It should be noted that the current through inductor L1 has likely not gone to zero before transistor Q4 is switched ON again. So, when transistor Q4 switches ON, the current starts flowing substantially instantaneously through resistors R39, R40, R47 and R48.

In addition, it should be noted that inductor L1, diode D6, resistor R69, capacitor C19, zener diode ZD9, resistor R68, capacitor C26, resistor R44 and resistor R67 define a conventional buck circuit. When transistor Q4 is switched ON, the current is pulled through LEDs load 115, resistor R69 and inductor L1, ramping up until the voltage across resistor R39 is enough to trigger CS (Current Sense) terminal 2 of U5 HV9910B chip. Then, transistor Q4 is switched OFF for an interval predefined by the value of resistor R44. While said transistor Q4 is switched OFF, the current circulates through inductor L1, LEDs load 115 and diode D6. Capacitor C19 smoothes out the voltage signal across LEDs load 115, so that the ripple of said voltage signal is minimized, and the current flowing through said LEDs load 115 is mostly DC current.

It should be noted that when more LEDs are being driven by means of the U5 HV9910B chip, then the output LEDs current is supposed to be the same as when fewer LEDs are being driven. However, the U5 HV9910B chip has limitations and changing a number of LEDs within LED load 115 from say twelve LEDs to one LED may increase the output current by 20%, for example. Therefore, to improve the uniformity of the output current, according to an embodiment of the present invention, the zener diode ZD9 and resistor R68 are provided. When there is a relatively large number of LEDs (e.g., twelve LEDs), the DC voltage across said zener diode ZD9 and resistor R68 is relatively low, such as 20V. On the other hand, when LED load 115 contains only one LED, then the voltage across said zener diode ZD9 and resistor R68 is approximately 56V (output 60V voltage minus 4V across said one LED). If zener diode ZD9 is set up, for example, to be 22V, then it substantially is not conducting when said LED load 115 contains said relatively large number of LEDs, (e.g., twelve LEDs). However, as the number of LEDs is decreased, the higher current flows through resistor R68 into terminal 2 of the U5 HV9910 chip, which is its current sensing terminal. Applying a current bias to said terminal 2 has an effect of lowering the current at which transistor Q4 is switched OFF at the end of each cycle, and hence it has an effect of lowering the current being supplied to LED load 115. This is known as a feedforward circuit (i.e. the settings of the circuit are changed according to the connections (e.g., LEDs) sensed). According to an embodiment of the present invention, as a result of the above, the output LED current is substantially independent of LED load 115 (independent of a number of LEDs), and can be within a relatively small tolerance, such as 5%.

According to an embodiment of the present invention, capacitor C26 operates with resistor R57 as an RC (Resistor-Capacitor) filter. Extraneous capacitance of Output stage circuit 135 leads to an initial spike through transistor Q4, when it is turned ON for the first time. Therefore, the time constant of said RC filter smoothes out this spike.

Also, resistor R69 is used to limit surges when LED load 115 is switched into Output circuit stage 135. For 18 W power, for example, the value of said resistor R69 can be approximately 1 to 2Ω, thus limiting the instantaneous output current to about 55 A, which is much less disruptive to the electronic circuit, than the possible "infinity" current.

The circuit defined by zener diode ZD7, resistors R66 [FIG. 2D only] and R41, and capacitor C31 is an application circuit for the U5 HV9910B chip. The properties of this circuit are that as long as sufficient power is being provided to. Input stage 120 (FIG. 1B) from TRIAC dimmer 105, then the output 60V signal (provided from terminal "+", and set to 60V with respect to terminal "−") stays substantially well regulated. Also, the output current provided into LED load 105 is independent of the input voltage provided to said Input stage 120 from said TRIAC dimmer 105. However, once said input voltage is so low that there is not sufficient power available to maintain said 60V signal, then the amplitude of the output current (provided into LED load 105) is reduced, tending to slow the falling voltage of said 60V signal, and also stabilizing the output current amplitude against circuit noise. In this region of operation, according to an embodiment of the present invention, the output current decreases in response to the falling input voltage.

Figure 3:
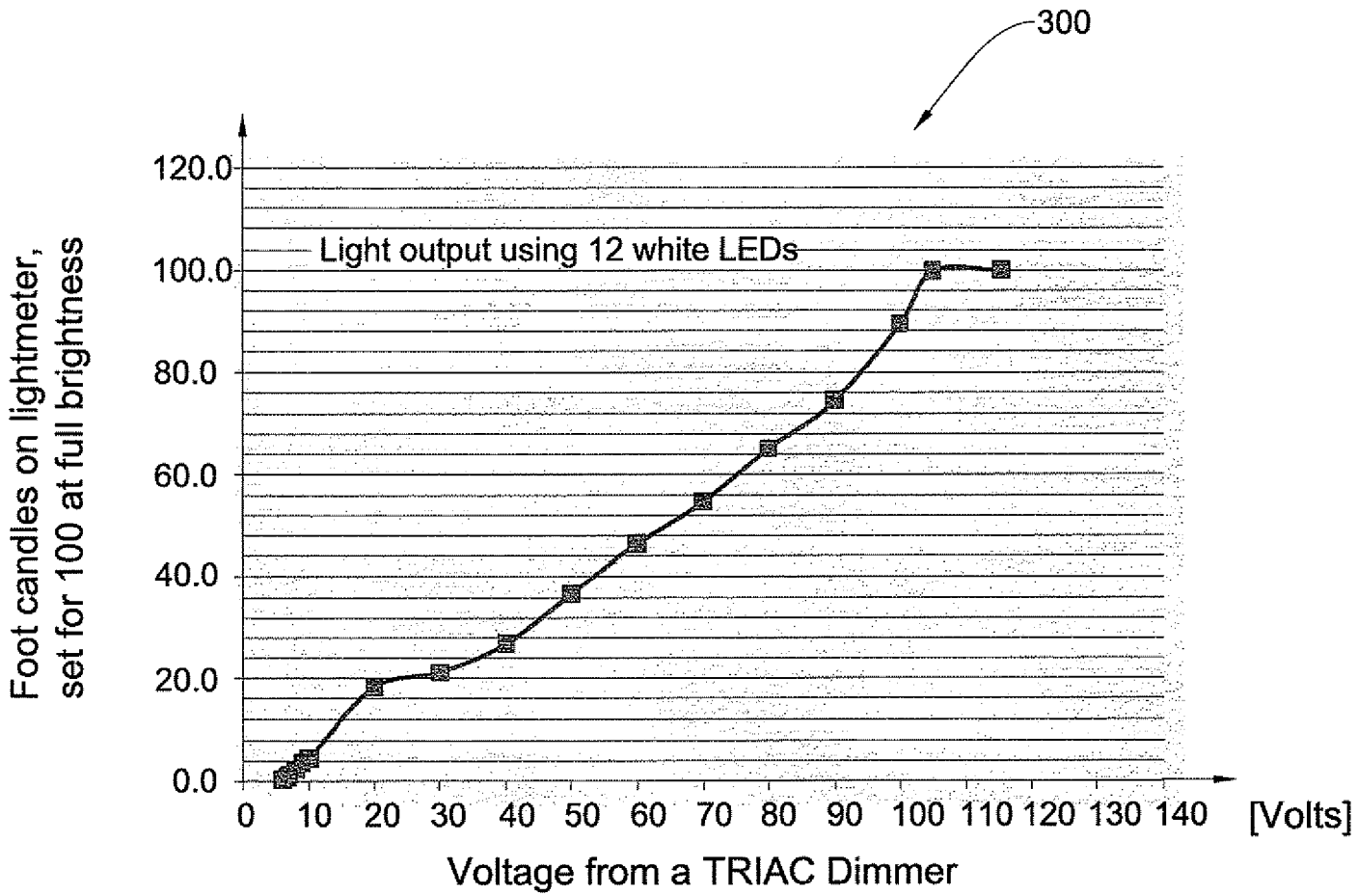
FIG. 3 is a sample chart showing experimental measurements of the light illumination generated by a LED load versus the voltage outputted from a TRIAC dimmer, according to an embodiment of the present invention.

FIG. 3 is a sample chart 300 showing experimental measurements of the light illumination generated by LED load 115 (FIG. 1A) versus the voltage outputted from TRIAC dimmer 105 (FIG. 1A), according to an embodiment of the present invention. Y-axis of chart 300 represents light brightness in the term of foot candles on a lightmeter, which was arbitrarily set to "100" at full brightness (it is supposed, for example, that at full brightness, LED load 115 includes twelve LEDs); X-scale of chart 300 represents the voltage outputted from TRIAC dimmer 105 (it is supposed, for example, that AC power line voltage is 120 Volts).

According to an embodiment of the present invention, less than 0.05% of the light illumination output can be still obtained substantially without flicker or shimmer.

Below is presented a table with sample characteristics of electronics components/units of system 100 (FIG. 1A) that are illustrated in FIGS. 2A-2D, according to an embodiment of the present invention.

TABLE 1

Sample characteristics of electronics components/units of system 100.

| Electronic component/unit | Symbols | Components/units characteristics |
|---|---|---|
| Capacitors | C1 | 0.027 μF |
| | C11, C32, C31 | 4.7 μF |
| | C12 | 470 μF |
| | C13 | 47 μF |
| | C14 | 470 pF |
| | C18 | 2.2 nF |
| | C19 | 1 μF |
| | C21 | 1 nF |
| | C23 | 0.047 μF |
| | C24 | 0.22 μF |
| | C25 | 2.2 nF |
| | C26 | 1000 pf |
| | C33 | 0.47 μF |
| | C16, C20, C28, C29, C34 | 1 μF |
| | C4 | 0.1 μF |
| | C5 | 4700 pf |
| | C6, C10, C15 | 0.1 μF |
| | C7 | 10 μF |
| Diodes | D1, D2, D3, D4 | Rectifier 1000 V 1 A |
| | D12 | Common Cathode Dual Schottky Diode |
| | D5 | 600 V 1 A |
| | D6, D7 | 200 V 1 A Schottky Diode |
| | D8, D13 | 70 V 215 mA Dual Diode |
| | D9, D14 | 200 V 1 A, Fast Recovery Diode |
| Fuse | F1 | Fuse 1 A |
| Inductors | L1 | 2.0 mH |
| | L2 | 2.3 mH, Differential Mode EMI |
| | L3 | 2.3 mH, Differential Mode EMI |
| Transistors | Q1 | 500 V npn-type transistor |
| | Q2 | 500 V pnp-type transistor |
| | Q3 | 600 V 11 A, n-channel transistor |
| | Q4 | 200 V 7 A, n-channel transistor |
| | Q5 | 100 V 1 A, npn-type transistor |
| | Q6 | n-channel FET (Field-Effect Transistor) |
| | Q7, Q8, Q9 | npn-type transistors |
| Resistors | R1 | 86.6 KΩ [KiloOhm] |
| | R10, R9 | 4.64 KΩ |
| | R11, R12 | 10 MΩ [MegOhm] |
| | R13 | 66.5 KΩ |
| | R14 | 1 KΩ |
| | R15 | 2.0 KΩ |
| | R16, R17, R18 | 680 KΩ |
| | R2 | 26.7 KΩ |
| | R20, R21, R22, R23, R60 | 1.0 Ω [Ohm] |
| | R24, R19 | 2.40 KΩ |
| | R25 | 10 Ω |
| | R27 | 681 KΩ |
| | R28 | 3.01 KΩ |
| | R29 | 82 KΩ |
| | R3 | 130 KΩ |
| | R30 | 15 KΩ |
| | R31, R46 | 430 Ω |
| | R32 | 20 KΩ |
| | R33 | 620 KΩ |
| | R34 | 47 KΩ |
| | R35, R36, R37, R56 | 16 KΩ |
| | R38, R49 | 1.6 MΩ |
| | R39, R40, R47, R48 | 2.55 Ω |
| | R4, R54, R55 | 100 KΩ |
| | R41 | 120 KΩ |
| | R42 | 374 KΩ |
| | R43 | 54.9 KΩ |
| | R44 | 180 KΩ |
| | R45 | 523 KΩ |
| | R5 | 2.00 KΩ |
| | R52 | 4.7 KΩ |
| | R53 | 2000 Ω |
| | R57 | 300 Ω |
| | R58 | 200 KΩ |
| | R59 | 4.87 MΩ |
| | R6 | 4.99 KΩ |

TABLE 1-continued

Sample characteristics of electronics components/units of system 100.

| Electronic component/unit | Symbols | Components/units characteristics |
|---|---|---|
| | R61 | 0.56 Ω |
| | R62 | 56 KΩ |
| | R64 | 2.70 KΩ |
| | R65 | 220 Ω |
| | R66 | 1.8 MΩ |
| | R67 | 470 Ω |
| | R68 | 154 KΩ |
| | R69 | 1 Ω |
| | R7, R63, R70 | 10 KΩ |
| | R8 | 10 KΩ |
| Flyback Transformer | T1 | 0.4 mH |
| Common Mode EMI Transformer | T2 | 47 mH |
| Quad Operational Amplifier | U1 ($U1_1$, $U1_2$, $U1_3$, $U1_4$) | Quad Operational Amplifier |
| Optocouplers | U2, U6 | |
| Power Factor Control (PFC) Integrated Circuit | U3 | Model number: L6562DTR |
| Regulator | U4 | 10 V terminal regulator |
| Constant Current LED Driver | U5 | Model number: HV9910B |
| Varistor | VR1 | 150 V RMS |
| Shunt Regulator | ZD1 | 2.5 V shunt regulator |
| TVS (Transient Voltage Suppressor) Diode | ZD2 | 170 V 600 W |
| Zener Diode | ZD3 | 3 V Zener Diode |
| Zener Diode | ZD4 | 15 V Zener Diode |
| Dual Zener Diode | ZD5, ZD6 | Dual 3.3 V Zener Diode |
| Zener Diode | ZD7 | 47 V Zener Diode |
| TVS Diode | ZD8 | 400 V |
| Zener Diode | ZD9 | 22 V Zener Diode |

Below is presented a table with sample characteristics of electronics components/units of system 100 (FIG. 1A) that are illustrated in FIGS. 4A-4D, according to an embodiment of the present invention.

TABLE 2

Sample characteristics of electronics components/units of system 100.

| Electronic component/unit | Symbols | Components/units characteristics |
|---|---|---|
| Capacitors | C1, C46 | 0.010 μF |
| | C12 | 470 μF |
| | C13 | 47 μF |
| | C14 | 470 pF |
| | C15 | 0.47 μF |
| | C16, C28 | 1 μF |
| | C18 | 3300 pF |
| | C19 | 1 μF |
| | C20, C45, C11 | 4.7 μF |
| | C21 | 4.7 nF |
| | C26 | 0.018 μF |
| | C23 | 0.047 μF |
| | C24 | 0.22 μF |
| | C25 | 0.01 μF |
| | C29 | 10 μF |
| | C7, C31 | 3.3 μF |
| | C33 | 0.22 μF |
| | C34 | 10 μF |
| | C37 | 1 μF |
| | C39 | Not used-open |
| | C4 | 0.047 μF |
| | C40 | 47 pF |
| | C41 | 0.1 μF |
| | C43 | 100 pF |
| | C49 | Not used-open |

TABLE 2-continued

Sample characteristics of electronics components/units of system 100.

| Electronic component/unit | Symbols | Components/units characteristics |
|---|---|---|
| | C5 | 4700 pf |
| | C6, C10, | 0.1 μF |
| Diodes | D1, D2, D3, D4 | 1N4937 1 A Rectifier |
| | D12, D8, D18 | Common Cathode Dual Schottky Diode |
| | D13 | 70 V 215 mA Anode-Cathode Dual Diode |
| | D15 | Not used-open. Fast Recovery Diode |
| | D19 | Common Cathode Dual Schottky Diode 40 V 200 mA |
| | D20 | Diode Switch Dual Common Cathode |
| | D5, D14 | 600 V 1 A, 500 ns |
| | D6 | 200 V 1 A, Fast Recovery Diode |
| | D7 | 1 A 400 V Ultra fast Diode |
| Fuse | F1 | Fuse 1 A |
| Inductors | L1 | 2.0 mH |
| | L2, L3 | 2.3 mH, Differential Mode EMI |
| | L4, L5, L6, L7 | 80 Ohm 100 MHz, Ferrite Bead |
| Transistors | Q1 | 500 V npn-type transistor |
| | Q2 | 500 V pnp-type transistor |
| | Q3 | 800 V 2 A, n-channel transistor |
| | Q4 | 200 V 7 A, n-channel transistor |
| | Q5 | 100 V 1 A, npn-type transistor |
| | Q6 | n-channel FET (Field-Effect Transistor) |
| | Q7, Q8, Q9 | npn-type transistors |
| Resistors | R1 | 10.2 KΩ [KiloOhm] |
| | R10, R9 | 47 KΩ |
| | R11, R12 | 10 MΩ [MegOhm] |
| | R13 | 66.5 KΩ |
| | R14 | 1.91 KΩ |
| | R15 | 2.0 KΩ |
| | R16, R17, R18 | 680 KΩ |
| | R19 | 2.4 KΩ |
| | R2 | 3.16 KΩ |
| | R20, R22, R23, R69, R82 | 2.0 Ω [Ohm] |
| | R21 | Not used-open |
| | R24 | 2.40 KΩ |
| | R25 | 220 Ω |
| | R27 | 210 KΩ |
| | R28 | 3.65 KΩ |
| | R29 | 47.0 KΩ |
| | R3 | 39 KΩ |
| | R30 | 15 KΩ |
| | R31 | 430 Ω |
| | R32 | 165 KΩ |
| | R33 | 620 KΩ |
| | R34, R74 | 47 KΩ |
| | R35, R36, R37 | 39 KΩ |
| | R38, R49 | 649 KΩ |
| | R39, R47, R48 | 2.40 Ω |
| | R4, R54, R55 | 100 KΩ |
| | R40 | 2.2 Ω |
| | R41 | 36 KΩ |
| | R42 | 590 KΩ |
| | R43 | 53.6 KΩ |
| | R44 | 150 KΩ |
| | R45 | 21.5 KΩ |
| | R46 | 56 Ω |
| | R5 | 931 Ω |
| | R52 | 4.7 KΩ |
| | R53 | 2000 Ω |

TABLE 2-continued

Sample characteristics of electronics components/units of system 100.

| Electronic component/unit | Symbols | Components/units characteristics |
|---|---|---|
| | R56 | 16 KΩ |
| | R57 | 22 Ω |
| | R58 | 200 KΩ |
| | R59 | 4.87 MΩ |
| | R6 | 4.99 KΩ |
| | R61 | 4.7 Ω |
| | R62 | 56 KΩ |
| | R63 | 750 Ω |
| | R64 | 1.2 KΩ |
| | R65 | 820 Ω |
| | R67 | 620 Ω |
| | R68 | 16 KΩ |
| | R7, R70 | 10 KΩ |
| | R71 | 680 Ω |
| | R72 | 22 KΩ |
| | R73 | 20 KΩ |
| | R75 | Not used-open |
| | R76 | 4.7 Ω |
| | R77 | Not used-open |
| | R79 | 500 Ohm Potentiometer |
| | R8 | 8.2 KΩ |
| | R80 | 36 KΩ |
| | R81 | 9.76 KΩ |
| Flyback Transformer | T1 | 0.5 mH |
| Common Mode EMI Transformer | T2 | 15 mH |
| Quad Operational Amplifier | U1 ($U1_1$, $U1_2$, $U1_3$, $U1_4$) | Quad Operational Amplifier |
| Optocouplers | U2, U6 | |
| Power Factor Control (PFC) Integrated Circuit | U3 | Model number: L6562DTR |
| Regulator | U4 | 10 V terminal regulator |
| Constant Current LED Driver | U5 | Model number: HV9910B |
| Varistor | VR1 | 320 V RMS |
| Shunt Regulator | ZD1 | 2.5 V shunt regulator |
| TVS (Transient Voltage Suppressor) Diode | ZD2 | 170 V 600 W |
| Zener Diode | ZD3 | 3 V Zener Diode |
| Zener Diode | ZD4 | 15 V Zener Diode |
| Dual Zener Diode | ZD5, ZD6 | Dual 47 V Zener Diode |
| Zener Diode | ZD7 | 47 V Zener Diode |
| TVS Diode | ZD8 | 400 V |
| Zener Diode | ZD9 | 22 V Zener Diode |

It should be understood that the component values presented above in Tables 1 and 2 are sample values, and that in other embodiments, the values of one or more of the components may vary, for instance with varying voltage, current and/or LED values.

In another aspect of the invention, pulse width modulation is not performed but only amplitude modulation is performed. For instance, pulse width modulator 127 may be omitted and a decoder such as phase decoder 126 may instead directly provide a signal to output stage 135 based on the desired dimming level which was encoded in the AC signal provided by the dimmer. This signal which is provided to Output stage 135 may be used to amplitude modulate the current outputted to load 115. In another instance, a pulse width modulator such as pulse width modulator 127 may be retained, receiving an input from a decoder such as phase decoder 126 based on the desired dimming level which was encoded in the AC signal provided by the dimmer. The PWM signal generated by the pulse width modulator and provided to Output stage 135 therefore also reflects the desired dimming level which was encoded in the AC signal provided by the dimmer. The PWM signal provided to output stage 135 will be used in this instance for amplitude modulation but not for pulse width modulation of the current outputted to load 115.

In another instance of this aspect, a PWM signal is generated by a pulse width modulator or a signal is provided by a decoder, either of which reflects the desired dimming level which was encoded in the AC signal provided by the dimmer. The signal from the pulse width modulator or decoder may be used by a controller or microcontroller in the Output stage to control amplitude modulation of the current provided to the load.

While some embodiments of the invention have been described by way of illustration, it will be apparent that the invention can be put into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A dimming driver circuitry configured to enable dimming an intensity of light generated by at least one light source, said dimming driver circuitry being connected to a dimmer that outputs to the dimming driver circuitry a phase controlled alternating current (AC) signal, wherein said dimming driver circuitry comprises:

circuitry for deriving an amplitude modulated signal from the phase controlled AC signal;

circuitry for deriving a pulse width modulated signal from the phase controlled AC signal; and an output stage for providing an output current to the at least one light source, wherein the output stage applies the amplitude modulated signal and the pulse width modulated signal to the output current at substantially the same time.

2. The dimming driver circuitry according to claim 1, wherein said circuitry for deriving a pulse width modulated signal from the phase controlled AC signal includes at least one linear dimming control pin connected to at least one capacitor and/or resistor which is configured to fine-tune capacitance and/or resistance in order to adjust said output current with respect to a predetermined dimming level reflected in said phase controlled AC signal.

3. The dimming driver circuitry according to claim 1, wherein said dimming driver circuitry does not include a processing unit.

4. The dimming driver circuitry according to claim 1, wherein said at least one light source includes at least one light emitting diode (LED).

5. A dimming driver circuitry configured to enable dimming an intensity of light generated by at least one light source that is connected to said dimming driver circuitry, said dimming driver circuitry being connected to a dimmer that outputs to the dimming driver circuitry a phase controlled alternating current (AC) signal, wherein said dimming driver circuitry includes:

circuitry for deriving an amplitude modulated signal from the phase controlled AC signal; and circuitry for deriving a pulse width modulated signal from the phase controlled AC signal, including at least one linear dimming control pin connected to at least one capacitor and/or resistor configured to fine-tune capacitance and/or resistance in order to adjust an onset point of dimming of said at least one light source with respect to a dimmer adjusting means position.

6. The dimming driver circuitry according to claim 5, wherein said at least one linear dimming control pin is used in a factory to fine-tune said capacitance and/or resistance.

7. The dimming driver circuitry according to claim 5, wherein said dimming driver circuitry does not include a processing unit.

8. The dimming driver circuitry according to claim 5, wherein said at least one light source includes at least one light emitting diode (LED).

9. A dimming driver circuitry configured to output a current which enables dimming an intensity of light generated by at least one light source, said dimming driver circuitry being connected to a dimmer that outputs to the dimming driver circuitry a phase controlled alternating current (AC) signal, wherein said dimming driver circuitry includes:

circuitry for deriving an amplitude modulated signal from the phase controlled AC signal; and circuitry for deriving a pulse width modulated signal from the phase controlled AC signal, including at least one linear dimming control pin connected to at least one capacitor and/or resistor configured to fine-tune capacitance and/or resistance in order to adjust said output current with respect to a predetermined dimming level reflected in said phase controlled AC signal, so that said light intensity is within 10% of average light intensity provided by a plurality of dimming driver circuitries when a plurality of dimmer adjusting means relating to said plurality of circuitries are positioned to correspond to a predetermined low light intensity.

10. The dimming driver circuitry according to claim 9, wherein said dimming driver circuitry does not include a processing unit.

11. The dimming driver circuitry according to claim 9, wherein said at least one light source includes at least one light emitting diode (LED).

12. A method of enabling dimming an intensity of light generated by at least one light source, comprising:

receiving an alternating current (AC) signal from a dimmer;

deriving an amplitude modulated signal and a pulse width modulated signal from the phase controlled AC signal; and providing an output current from an output stage of a dimming driver circuitry to said at least one light source, wherein the output stage applies the amplitude modulated signal and the pulse width modulated signal to the output current at substantially the same time.

13. A method of enabling dimming an intensity of light generated by at least one light source, comprising:

receiving a phase controlled alternating current AC signal from a dimmer; and deriving an amplitude modulated signal and a pulse width modulated signal from the phase controlled AC signal, wherein deriving the pulse width modulated signal from the phase controlled AC signal, includes fine-tuning capacitance and/or resistance using a linear dimming control pin, in order to adjust an onset point of dimming of said at least one light source with respect to a position of an adjusting means of said dimmer.

14. A method of outputting a current which enables dimming the intensity of light generated by at least one light source, comprising:

receiving a phase controlled alternating current AC signal from a dimmer, reflecting a predetermined dimming level; and deriving an amplitude modulated signal and a pulse width modulated signal from the phase controlled AC signal, wherein deriving the pulse width modulated signal from the phase controlled AC signal, includes fine-tuning capacitance and/or resistance using a linear dimming control pin, in order to adjust said output current with respect to said predetermined dimming level, so that said light intensity is within 10% of average light intensity provided by a plurality of dimming driver circuitries when a plurality of dimmer adjusting means relating to said plurality of circuitries are positioned to correspond to a predetermined low light intensity.

15. A dimming driver circuitry configured to enable dimming an intensity of light generated by at least one light source, said dimming driver circuitry being connected to a dimmer that outputs to the dimming driver circuitry a phase controlled alternating current (AC) signal, wherein said dimming driver circuitry, after receiving said phase controlled AC signal, generates an amplitude modulated signal and a pulse width modulated signal used to modulate an output current provided to said at least one light source;

wherein said dimming driver circuitry is configured to apply the amplitude modulated signal and the pulse width modulated signal to the output current at substantially at the same time.

* * * * *